US009324263B2

(12) United States Patent
Sugimoto et al.

(10) Patent No.: US 9,324,263 B2
(45) Date of Patent: Apr. 26, 2016

(54) DISPLAY DRIVER, DISPLAY DRIVING METHOD AND DISPLAY DEVICE

(71) Applicant: Futaba Corporation, Mobara-shi (JP)

(72) Inventors: Terukazu Sugimoto, Mobara (JP); Hiroyuki Tanaka, Mobara (JP)

(73) Assignee: FUTABA CORPORATION, Mobara-Shi (JP)

( * ) Notice: Subject to any disclaimer, the term of this patent is extended or adjusted under 35 U.S.C. 154(b) by 0 days.

(21) Appl. No.: 14/313,321

(22) Filed: Jun. 24, 2014

(65) Prior Publication Data

US 2015/0002564 A1 Jan. 1, 2015

(30) Foreign Application Priority Data

Jun. 28, 2013 (JP) ..... 2013-136376

(51) Int. Cl.

*G09G 5/02* (2006.01)
*G09G 3/32* (2006.01)
*G09G 3/20* (2006.01)

(52) U.S. Cl.

CPC ..... *G09G 3/3216* (2013.01); *G09G 3/2014* (2013.01); *G09G 2310/0272* (2013.01); *G09G 2320/0233* (2013.01); *G09G 2320/0285* (2013.01)

(58) Field of Classification Search

CPC . G09G 3/2014; G09G 3/3216; G09G 3/3622; G09G 2310/0267; G09G 2310/0272; G09G 2320/0233; G09G 2320/0271; G09G 2320/0285; G09G 3/3215; G09G 3/3233; G09G 3/3291; G09G 3/3611

See application file for complete search history.

(56) References Cited

U.S. PATENT DOCUMENTS

2003/0122759 A1 7/2003 Abe et al.
2005/0007392 A1 1/2005 Kasai et al.
2005/0024310 A1* 2/2005 Shiomi ..... G09G 3/3648 345/89
2005/0162361 A1 7/2005 Chuang et al.
2005/0168424 A1* 8/2005 Nakamoto ..... G09G 3/3611 345/89
2006/0007084 A1* 1/2006 Takeoka ..... G09G 3/3648 345/87

(Continued)

FOREIGN PATENT DOCUMENTS

JP 2003-195798 A 7/2003
JP 2003-255884 A 9/2003
KR 10-2013-0058496 A 6/2013

OTHER PUBLICATIONS

Japanese Office Action dated Mar. 27, 2015 issued in corresponding Japanese application No. 2013-136376 and English translation thereof.

(Continued)

*Primary Examiner* — Joe H Cheng
(74) *Attorney, Agent, or Firm* — Bacon & Thomas, PLLC

(57) ABSTRACT

A display driver for driving data lines according to gradation values of pixels in a display unit is provided. The display driver includes a correction value generating unit configured to count the number of display data for each of the gradation values in display data corresponding to pixels on each of scanning lines on a scanning line basis, and generate correction values of the display data based on the counting result, and a driving signal generating unit configured to perform a correction process to the display data by using the correction values generated by the correction value generating unit, and generate a data line driving signal for driving each of the data lines based on the corrected display data.

20 Claims, 20 Drawing Sheets

(56) References Cited

U.S. PATENT DOCUMENTS

2007/0001932 A1* 1/2007 Miyazaki ..... G09G 3/2022 345/60
2007/0252795 A1* 11/2007 Shiomi ..... G09G 3/2048 345/87
2008/0043027 A1* 2/2008 Shiomi ..... G09G 3/3648 345/501
2008/0062163 A1 3/2008 Uchida et al.
2008/0238951 A1* 10/2008 Kai ..... G09G 3/20 345/690
2010/0134482 A1* 6/2010 Ogura ..... G09G 3/3291 345/214
2011/0050744 A1* 3/2011 Kikuta ..... G09G 3/3233 345/690
2011/0157134 A1* 6/2011 Ogura ..... G09G 3/20 345/211
2011/0254874 A1* 10/2011 Kikuta ..... G09G 3/2092 345/690
2011/0279487 A1* 11/2011 Imamura ..... G09G 3/3611 345/690
2011/0298774 A1* 12/2011 Yamada ..... G09G 3/3614 345/211
2013/0135272 A1 5/2013 Park
2013/0162698 A1 6/2013 Sasaki et al.
2014/0078035 A1* 3/2014 Sato ..... G09G 3/344 345/107
2014/0146097 A1* 5/2014 Kimura ..... G09G 3/3648 345/690
2014/0340431 A1* 11/2014 Yamakawa ..... G09G 3/3426 345/690

OTHER PUBLICATIONS

Korean Office Action dated Jul. 29, 2015 issued in corresponding Korean Patent Application No. 10-2014-0078744 and English translation thereof.
Taiwanese Office Action, including Search Report, dated Oct. 7, 2015 issued in corresponding Taiwanese Patent Application No. 103122325 and partial English translation thereof.
Chinese Office Action, including Search Report, dated Dec. 30, 2015 issued in corresponding Chinese Patent Application No. 201410302224.8 and English translation thereof.

* cited by examiner

FIG. 3A

GRADATION TABLE

| GRADATION VALUE | 4-BIT BINARY DATA | TARGET COUNT VALUE | PULSE WIDTH |
|---|---|---|---|
| 15/15 | 1111 | 480 | 120μs |
| 14/15 | 1110 | 320 | 80μs |
| 13/15 | 1101 | 240 | 60μs |
| 12/15 | 1100 | 200 | 50μs |
| 11/15 | 1011 | 160 | 40μs |
| 10/15 | 1010 | 120 | 30μs |
| 9/15 | 1001 | 100 | 25μs |
| 8/15 | 1000 | 80 | 20μs |
| 7/15 | 0111 | 72 | 18μs |
| 6/15 | 0110 | 64 | 16μs |
| 5/15 | 0101 | 56 | 14μs |
| 4/15 | 0100 | 48 | 12μs |
| 3/15 | 0011 | 40 | 10μs |
| 2/15 | 0010 | 32 | 8 μs |
| 1/15 | 0001 | 24 | 6 μs |
| 0/15 | 0000 | 0 | 0 μs |

( 1 COUNT = 0.25 μs )

LOOK-UP TABLE

| GRADATION VALUE NUMBER | CORRECTION AMOUNT | PULSE WIDTH CORRECTION AMOUNT |
|---|---|---|
| 0~50 | 0 | NO CHANGE |
| 51~100 | -4 | -1μs |
| 101~125 | -8 | -2μs |
| 126~150 | -12 | -3μs |
| 151~175 | -16 | -4μs |
| 176~200 | -20 | -5μs |
| 201~256 | -24 | -6μs |

( 1 COUNT = 0.25 μs )

| GRADATION VALUE | THE NUMBER OF DISPLAY DATA | |
|---|---|---|
| 15/15 | 0 | |
| 14/15 | 0 | |
| 13/15 | 0 | |
| 12/15 | 0 | |
| 11/15 | 0 | |
| 10/15 | 0 | |
| 9/15 | 0 | |
| 8/15 | 146 | → −12(−3 μs) |
| 7/15 | 0 | |
| 6/15 | 0 | |
| 5/15 | 0 | |
| 4/15 | 0 | |
| 3/15 | 0 | |
| 2/15 | 110 | → −8(−2 μs) |
| 1/15 | 0 | |
| 0/15 | 0 | |
| TOTAL | 256 | |

*FIG. 7C*

| GRADATION VALUE | THE NUMBER OF DISPLAY DATA | |
|---|---|---|
| 15/15 | 0 | |
| 14/15 | 0 | |
| 13/15 | 0 | |
| 12/15 | 128 | |
| 11/15 | 0 | |
| 10/15 | 0 | |
| 9/15 | 0 | |
| 8/15 | 0 | |
| 7/15 | 0 | |
| 6/15 | 128 | → −12(−3 μs) |
| 5/15 | 0 | |
| 4/15 | 0 | |
| 3/15 | 0 | |
| 2/15 | 0 | |
| 1/15 | 0 | |
| 0/15 | 0 | |
| TOTAL | 256 | |

*FIG. 7D*

| GRADATION VALUE | THE NUMBER OF DISPLAY DATA | |
|---|---|---|
| 15/15 | 0 | |
| 14/15 | 0 | |
| 13/15 | 16 | → 0 |
| 12/15 | 0 | |
| 11/15 | 0 | |
| 10/15 | 120 | → −8(−2 μs) |
| 9/15 | 0 | |
| 8/15 | 60 | → −4(−1 μs) |
| 7/15 | 0 | |
| 6/15 | 0 | |
| 5/15 | 0 | |
| 4/15 | 0 | |
| 3/15 | 0 | |
| 2/15 | 0 | |
| 1/15 | 60 | → −4(−1 μs) |
| 0/15 | 0 | |
| TOTAL | 256 | |

FIG. 7E

CORRECTION TABLE

| GRADATION VALUE | COUNT CORRECTION VALUE | PULSE WIDTH CORRECTION AMOUNT |
|---|---|---|
| 15/15 | 0 | 0 |
| 14/15 | 0 | 0 |
| 13/15 | 0 | 0 |
| 12/15 | 0 | 0 |
| 11/15 | 0 | 0 |
| 10/15 | 0 | 0 |
| 9/15 | 0 | 0 |
| 8/15 | −8 | −2 μs |
| 7/15 | 0 | 0 |
| 6/15 | 0 | 0 |
| 5/15 | 0 | 0 |
| 4/15 | 0 | 0 |
| 3/15 | 0 | 0 |
| 2/15 | 0 | 0 |
| 1/15 | 0 | 0 |
| 0/15 | 0 | 0 |

*FIG. 7F*

CORRECTION TABLE

| GRADATION VALUE | COUNT CORRECTION VALUE | PULSE WIDTH CORRECTION AMOUNT |
|---|---|---|
| 15/15 | 0 | 0 |
| 14/15 | 0 | 0 |
| 13/15 | −16 | −4 μs |
| 12/15 | 0 | 0 |
| 11/15 | 0 | 0 |
| 10/15 | −8 | −2 μs |
| 9/15 | 0 | 0 |
| 8/15 | −4 | −1 μs |
| 7/15 | 0 | 0 |
| 6/15 | 0 | 0 |
| 5/15 | 0 | 0 |
| 4/15 | 0 | 0 |
| 3/15 | 0 | 0 |
| 2/15 | 0 | 0 |
| 1/15 | 0 | 0 |
| 0/15 | 0 | 0 |

*FIG. 8A*

BEFORE CORRECTION

| GRADATION VALUE | PULSE WIDTH |
|---|---|
| 15/15 | 120μs |
| 14/15 | 80μs |
| 13/15 | 60μs |
| 12/15 | 50μs |
| 11/15 | 40μs |
| 10/15 | 30μs |
| 9/15 | 25μs |
| 8/15 | 20μs |
| 7/15 | 18μs |
| 6/15 | 16μs |
| 5/15 | 14μs |
| 4/15 | 12μs |
| 3/15 | 10μs |
| 2/15 | 8μs |
| 1/15 | 6μs |
| 0/15 | 0μs |

AFTER CORRECTION

| GRADATION VALUE | PULSE WIDTH |
|---|---|
| 15/15 | 120μs |
| 14/15 | 80μs |
| 13/15 | 56μs |
| 12/15 | 50μs |
| 11/15 | 40μs |
| 10/15 | 28μs |
| 9/15 | 25μs |
| 8/15 | 19μs |
| 7/15 | 18μs |
| 6/15 | 16μs |
| 5/15 | 14μs |
| 4/15 | 12μs |
| 3/15 | 10μs |
| 2/15 | 8μs |
| 1/15 | 6μs |
| 0/15 | 0μs |

DISPLAY DRIVER, DISPLAY DRIVING METHOD AND DISPLAY DEVICE

FIELD OF THE INVENTION

The present invention relates to a display driver, a display driving method and a display device, and particularly to technology of driving a display unit in which data lines and scanning lines are arranged and pixels are formed at respective intersections of the data lines and the scanning lines.

BACKGROUND OF THE INVENTION

As a display panel for displaying an image, there are known a display device using an organic light emitting diode (OLED), a display device using a liquid crystal display (LCD) and the like. In many cases, the display device includes a display unit in which data lines each of which is connected in common to a plurality of pixels arranged in the column direction, and scanning lines each of which is connected in common to a plurality of pixels arranged in the row direction, are provided and pixels are provided at the respective intersections of the data lines and the scanning lines.

Thus, in the case of so-called line sequential scanning, a scanning line driver sequentially selects the scanning lines and a data line driver outputs data line driving signals to the respective data lines corresponding to the pixels of the selected scanning line, thereby controlling the display of each dot as the pixel.

Japanese Patent Application Publication No. H9-232074 discloses a technique in which all scanning lines are once connected to a reset potential when the scanning is sequentially switched one scanning line to another scanning line, thereby preventing a delay of the start of the light emission of the pixels due to parasitic capacitance of the display panel.

Japanese Patent Application Publication No. 2004-309698 discloses a technique in which all data electrodes are connected to a reset potential and subsequently connected to a preset potential when display signals are supplied to data electrodes, thereby reducing overshoot and undershoot on the display signals.

In the case of, e.g., a passive OLED display device, when selecting and driving one scanning line in which pixels have mixed gradations, there occurs a phenomenon that, when an anode driving signal having a relatively low luminance is turned off, an anode voltage of the anode driving signal overshoots. This may result in an display image having locally a higher luminance than an original luminance and display unevenness on the display image.

SUMMARY OF THE INVENTION

In view of the above, the present invention provides a display driver, a display driving method and a display device, which are capable of reducing a luminance variation due to an overshoot on the display signal and suppressing luminance unevenness (display unevenness).

In accordance with an aspect of the present invention, there is provided a display driver for driving data lines in a display unit, the display unit including the data lines each of which is connected in common to a plurality of pixels arranged in a column direction, scanning lines each of which is connected in common to a plurality of pixels arranged in a row direction, and pixels formed to correspond to respective intersections of the data lines and the scanning lines, the display driver driving the data lines according to gradation values of the pixels. Further, the display driver includes: a correction value generating unit configured to count the number of display data for each of the gradation values in display data corresponding to pixels on each of the scanning lines on a scanning line basis, and generate correction values of the display data based on the counting result; and a driving signal generating unit configured to perform a correction process to the display data by using the correction values generated by the correction value generating unit, and generate a data line driving signal for driving each of the data lines based on the corrected display data.

In the case where signals according to gradation values of the pixels are applied to each of the data lines, an overshoot may occur on the signal applied to one of the pixels due to influences of the number of the other pixels and gradations of the other pixels. In the present invention, it is not intended to eliminate the overshoot itself but it is intended to make the corresponding pixel emit light with its original luminance. To that ends, the corrected data line driving signal is applied to corresponding pixel.

Specifically, a display data representing a gradation of each of the pixels is corrected, and the data line driving signal is generated based on the corrected display data. Display data to be corrected and a correction amount thereof is determined according to the number of display data for each gradation in the display data of the corresponding scanning line. Thus, it is possible to perform the correction process on the display data corresponding to portions where the display unevenness otherwise occurs due to the overshoot, with a proper correction amount.

In the display driver, the correction value generating unit may obtain a correction amount according to the number of display data for each of the gradation values, and generate the correction values of the display data by using the obtained correction amount for each of the gradation values to calculate a correction amount for a gradation value higher than the gradation value corresponding to the obtained correction amount.

The overshoot affects the luminance of the display area of the higher gradation depending on the number of display data for the lower gradation in the same scanning line. Therefore, the correction amount for the display data of the higher gradation is determined by using the correction amount according to the number of display data for each of the gradation values.

In the display driver, the correction value generating unit may generate the correction values according to the counting result of the number of display data for each of the gradation values by using a look-up table showing a correspondence between the number of display data for each of the gradation values and the correction amount therefor.

By storing the number of display data for each of the gradation values and the correction amount corresponding thereto in the look-up table, it is possible to obtain the correction amount corresponding to the number of display data for each gradation value by referring to the look-up table.

In the display driver, a constant current signal having a duration corresponding to each of the gradation values may be applied as the data line driving signal to the data lines, and the correction amount stored in the look-up table may correspond to a value for shortening the duration.

With this configuration, even when the luminance is increased due to the overshoot, the luminance on the display image can be lowered by shortening the duration for which the constant current is applied to the corresponding pixel.

In the display driver, it is preferred that one or both of the correction amount and the number of display data stored in the look-up table is rewritable. Thus, it is possible to update the look-up table with a proper correction amount according to a change in the specification of the display unit.

In the display driver, preferably, a constant current signal having a duration corresponding to each of the gradation values is applied as the data line driving signal to the data lines, and the correction value generating unit performs the correction process only for display data having a gradation value in which the corresponding duration is greater than a threshold value.

By doing this, it is possible to prevent the low gradation area (black display area) from becoming too much dark by the correction process.

In the display driver, the driving signal generating unit may perform the correction process by limiting the correction amount such that a gradation value of the corrected display data becomes greater than a value corresponding to a gradation value immediately below the gradation value of the corrected display data.

With this configuration, it is possible to maintain the gradation in the display image by preventing the difference between the gradations from disappearing by the correction process.

In accordance with another aspect of the present invention, there is provided a display driving method for driving data lines according to gradation values of pixels in a display unit, the display unit including the data lines each of which is connected in common to a plurality of pixels arranged in a column direction, scanning lines each of which is connected in common to a plurality of pixels arranged in a row direction, and the pixels formed to correspond to respective intersections of the data lines and the scanning lines, the display driving method including: counting the number of display data for each of the gradation values in display data corresponding to pixels on each of the scanning lines on a scanning line basis, and generating correction values of the display data according to the counting result; and performing a correction process to the display data by using the generated correction values, and generating a data line driving signal for driving each of the data lines based on the corrected display data.

With this configuration, it is possible to cope with the change in luminance due to the overshoot in a data line signal by correcting the display data.

In accordance with still another aspect of the present invention, there is provided a display device including: a display unit including data lines each of which is connected in common to a plurality of pixels arranged in a column direction, scanning lines each of which is connected in common to a plurality of pixels arranged in a row direction, and pixels formed to correspond to respective intersections of the data lines and the scanning lines; a display driver configured to drive each of the data lines according to gradation values of the corresponding pixels; and a scanning line driver configured to apply a scanning signal to the scanning lines. Further, the display driver includes: a correction value generating unit configured to count the number of display data for each of the gradation values in display data corresponding to pixels on each of the scanning lines on a scanning line basis, and generate correction values of the display data based on the counting result; and a driving signal generating unit configured to perform a correction process to the display data by using the correction values generated by the correction value generating unit, and generate a data line driving signal for driving each of the data lines based on the corrected display data.

That is, the display device includes the display driver described above.

With the above configuration, it is possible to offset a visible luminance variation due to an overshoot of the data line drive signal by correcting the data line driving signal. As a result, it is possible to reduce display unevenness (luminance unevenness), and improving the display quality.

BRIEF DESCRIPTION OF THE DRAWINGS

The objects and features of the present invention will become apparent from the following description of embodiments, given in conjunction with the accompanying drawings, in which:

FIGS. 3A to 3C are diagrams for explaining a gradation table, an anode drive output and a look-up table of the embodiment;

FIGS. 7A to 7F are diagrams for explaining how a correction table is created according to the embodiment;

FIGS. 8A to 8D are diagrams for explaining a pulse width change according to the correction of the embodiment.

DETAILED DESCRIPTION OF THE EMBODIMENTS

Hereinafter, an embodiment of the present invention will be described with reference to the drawings which form a part hereof.

<Configuration of Display Device and Display Driver>

Figure 1:
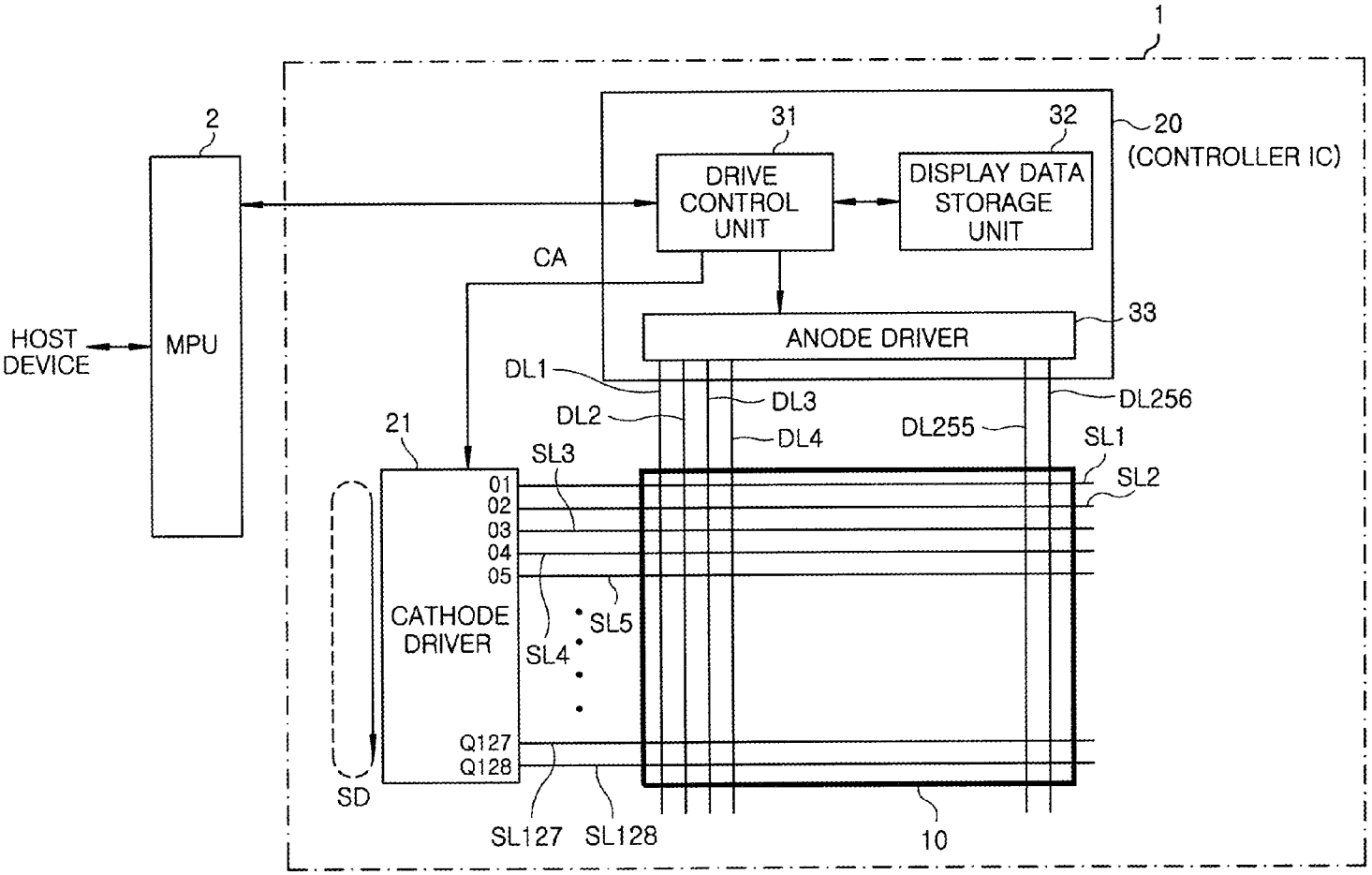
FIG. 1 is a block diagram of an example of a display device in accordance with an embodiment of the present invention.

FIG. 1 shows a display device 1 in accordance with an embodiment and a micro processing unit (MPU) 2 for controlling a display operation of the display device 1. The display device 1 includes a display unit 10 serving as a display screen, a controller integrated circuit (IC) 20 and a cathode driver 21. Further, the display device 1 corresponds to a display device described in the claims. Further, the controller IC 20 corresponds to a display driver (or display driving unit) described in the claims.

The display unit 10 includes data lines DL (specifically, DL1 to DL256), scanning lines SL (specifically, SL1 to SL128), and pixels provided at intersections of the data lines DL and the scanning lines SL. For example, 256 data lines DL1 to DL256 and 128 scanning lines SL1 to SL128 are disposed. Accordingly, 256 pixels are arranged in a horizontal direction and 128 pixels are arranged in a vertical direction. Thus, the display unit 10 has pixels of 256×128=32768 as pixels constituting a display image. In the present embodiment, each pixel is formed of a self-emitting element using an OLED. Further, the number of pixels, the number of data lines and the number of scanning lines are merely exemplary.

Each of 256 data lines DL1 to DL256 is connected in common to 128 pixels arranged in a column direction (vertical direction) of the display unit 10. Further, each of 128 scanning lines SL1 to SL128 is connected in common to 256 pixels arranged in a row direction (horizontal direction). When driving signals based on display data (luminance value) are applied from the data lines DL to the 256 pixels of a selected scanning line SL, each pixel of the selected line is driven to emit light at the luminance (gradation) based on the display data.

The controller IC 20 and the cathode driver 21 are provided for driving the display of the display unit 10. The controller IC 20 includes a drive control unit 31, a display data storage unit 32 and an anode driver 33. The anode driver 33 drives the data lines DL1 to DL256. In the present embodiment, when the drive control unit 31 applies a pulse signal having a pulse width corresponding to a gradation, the anode driver 33 outputs a constant current to each of the data lines DL during an ON-duty period of the pulse signal. In the following description, the pulse signal and the constant current signal applied to each of the data lines DL are generically referred to as the "data line driving signal," but when specifically differentiated, the data line driving signal as the pulse signal is noted or referred to as an "anode instruction signal," and the constant current signal applied to each of the data lines DL is noted or referred to as an "anode driver output signal."

The drive control unit 31 communicates a command and display data with the MPU 2 and controls the display operation according to the command. For example, when receiving a display start command, the drive control unit 31 performs the timing setting and allows the cathode driver 21 to start the scanning of the scanning lines SL. Further, the drive control unit 31 performs the driving of the 256 data lines DL from the anode driver 33 in synchronization with the scanning by the cathode driver 21.

For the driving of the data lines DL by the anode driver 33, the drive control unit 31 stores the display data received from the MPU 2 in the display data storage unit 32 and supplies the data line driving signal (anode instruction signal) to the anode driver 33 based on the display data in synchronization with the scanning by the cathode driver 21. Accordingly, the anode driver 33 outputs a data line driving signal (anode driver output signal) corresponding to a gradation, to the data lines DL. By this control, each pixel on the selected line, i.e., one scanning line SL selected by a scanning signal applied from the cathode driver 21, is driven to emit light. In this way, all the lines are sequentially driven to emit light, so that a frame of image display is realized.

The cathode driver 21 functions as a scanning line driver for applying a scanning signal to one ends of the scanning lines SL. The cathode driver 21 is disposed such that output terminals Q1 to Q128 are connected to one ends of the scanning lines SL1 to SL128, respectively. By sequentially outputting scanning signals of the selection level from the output terminal Q1 toward the output terminal Q128 in a scanning direction SD as illustrated in FIG. 1, scanning is performed to sequentially select the scanning lines SL1 to SL128.

Figure 2A:
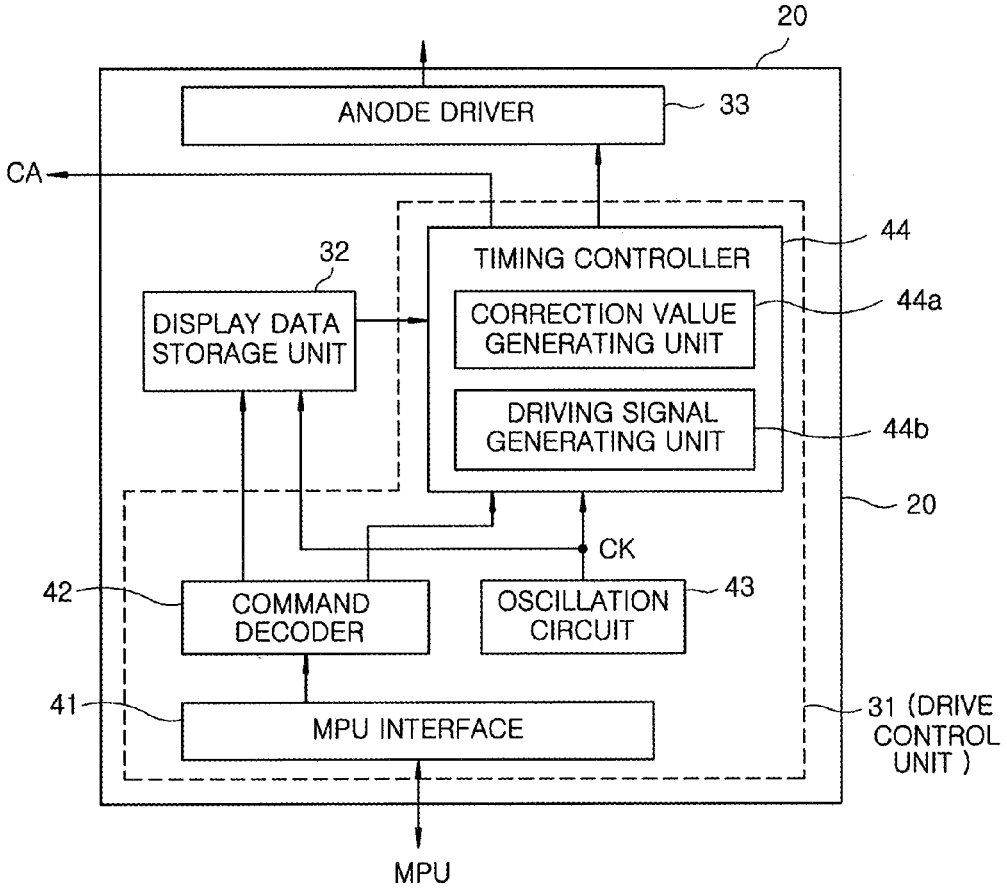
FIGS. 2A and 2B are block diagrams of a controller IC and a timing controller of the embodiment, respectively.

FIG. 2A shows configuration of the controller IC 20 which functions as a display driver, and particularly shows in detail the drive control unit 31. As shown in FIG. 2A, the drive control unit 31 includes a MPU interface 41, a command decoder 42, an oscillation circuit 43 and a timing controller 44.

The MPU interface 41 is an interface circuit for performing various communications with the MPU 2. Specifically, the MPU interface 41 allows transmission and reception of the display data or a command signal to and from the MPU 2. The command decoder 42 puts the command signal transmitted from the MPU 2 into an internal register (not shown) and decodes the command signal. Then, the command decoder 42 informs the timing controller 44 of necessary information to execute an operation according to the content of the command signal. Further, the command decoder 42 stores the display data transmitted from the MPU 2 in the display data storage unit 32.

The oscillation circuit 43 generates a clock signal CK for display drive control. The clock signal CK is supplied to the display data storage unit 32 and used as a clock for data write and read operations. Further, the clock signal CK is supplied to the timing controller 44 and is used for operations thereof.

The timing controller 44 sets the driving timing of the scanning lines SL and the data lines DL of the display unit 10. Then, the timing controller 44 outputs a cathode driver control signal CA to execute the line scanning by the cathode driver 21.

Further, the timing controller 44 outputs the data line driving signal (anode instruction signal) to the anode driver 33 to perform the driving of the data lines DL. To that end, the timing controller 44 reads the display data from the display data storage unit 32 and generates the data line driving signal based on the display data. Thus, in synchronization with the scanning timing of the respective scanning lines SL, the anode driver 33 outputs a constant current corresponding to the data line driving signal, to each pixel of the selected line.

Particularly, in the present embodiment, the timing controller 44 includes, as configuration for the anode driver 33, a correction value generating unit 44*a* and a driving signal generating unit 44*b* as illustrated.

The correction value generating unit 44*a* counts the number of display data for each of different gradation values in display data to be applied to the pixels of each of the scanning lines SL on a scanning line basis, and generates correction values of the display data based on the counting result. The driving signal generating unit 44*b* performs a correction process on the display data by using the correction values generated by the correction value generating unit 44*a*, and generates the data line driving signal (anode instruction signal) for driving each of the data lines DL based on the corrected display data.

Figure 2B:
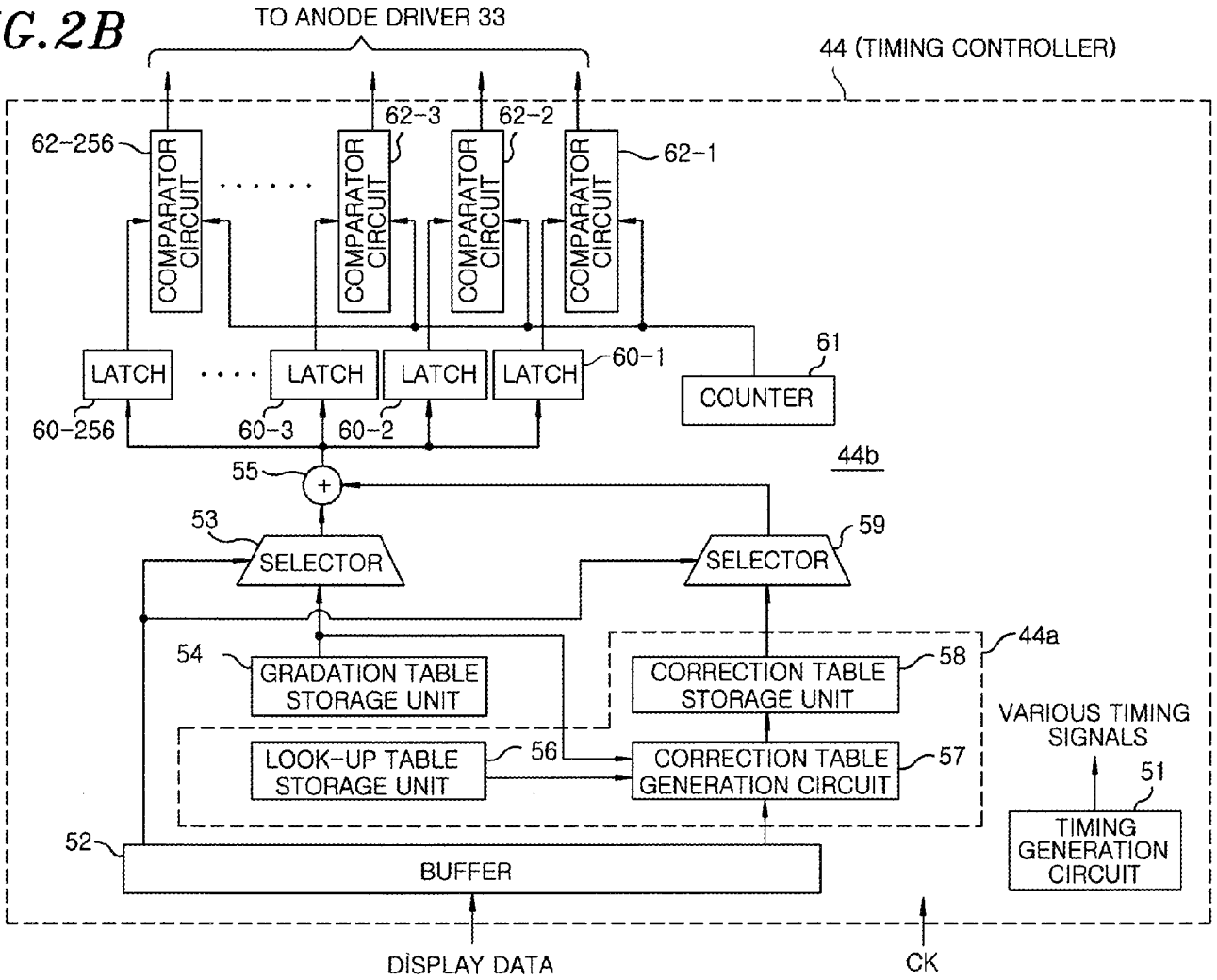

FIG. 2B shows a specific configuration example of the correction value generating unit 44*a* and the driving signal generating unit 44*b*. As shown in FIG. 2B, the correction value generating unit 44*a* includes a look-up table storage unit 56, a correction table generation circuit 57 and a correction table storage unit 58. Further, the driving signal generating unit 44*b* includes a buffer 52, selectors 53 and 59, a gradation table storage unit 54, an adder 55, a latch circuit 60 (specifically, 60-1 to 60-256), a counter and a comparator circuit 62 (specifically, 62-1 to 62-256). A timing generation circuit 51 controls the operation timing of respective parts which form the correction value generating unit 44*a* and the driving signal generating unit 44*b*.

First, operations except the correction process will be described with reference to FIG. 2B. The timing controller 44 puts the display data stored in the display data storage unit 32 into the buffer 52 on a scanning line basis, and generates the data line driving signal based thereon. Specifically, the display data for one scanning line (display data for 256 pixels) are read from the display data storage unit 32 and are put (temporarily stored) into the buffer 52. Each of the display data is, for example, O-bit data per pixel which represents one of 16 gradations. The buffered display data for one scanning line, i.e., the display data for 256 pixels, are supplied to the selector 53 on a pixel (4-bit) basis. The selector 53 selects and outputs a target count value stored in the gradation table storage unit 54 according to the 4-bit gradation value.

For example, FIG. 3A shows a gradation table stored in the gradation table storage unit 54 in which the 4-bit binary data are respectively associated with the target count values. For reference, the gradation value and the pulse width are also shown in FIG. 3A, but it is not necessary to store them as the actual table data. The gradation values represent 16 gradation values, each denoted by "0/15" to "15/15", having 4-bit binary data "0000" to "1111", respectively. In this case, "0/15" corresponds to a black display gradation having the minimum luminance, and "15/15" corresponds to a white display gradation having the maximum luminance.

The pulse width corresponds to the On-duty period of the pulse signal as the data line driving signal (anode instruction signal) controlled by the target count value, and is a period of time for which a constant current as the anode driver output signal is outputted. In this example, one count of the target count value corresponds to 0.25 μs. For example, if the target count value is 480, the pulse width is 120 μs.

The selector 53 reads and outputs the target count value corresponding to the 4-bit display data (gradation) by referring to the gradation table stored in the gradation table storage unit 54. For example, if the 4-bit display data is "1100" (12/15 gradation values), the target count value of 200 is outputted. The target count value is obtained by converting the gradation value of the display data into a time value, and is substantially a value corresponding to the gradation of the display data. If no correction is performed, the target count value outputted from the selector 53 is latched by the latch circuit 60 as it is. In case of performing the correction to be described later, arithmetic processing for correction is carried out on the target count value outputted from the selector 53 by the adder 55.

The latch circuit 60 includes a plurality of latch circuits (256 latch circuits 60-1 to 60-256 in this example) provided to correspond to the respective pixels of one scanning line. The target count values selected based on the display data for one scanning line are latched by the respective latch circuits 60. Thus, the respective target count values for pixels of one scanning line are introduced into the corresponding latch circuits 60-1 to 60-256. The target count value latched by each of the latch circuits 60-1 to 60-256 is compared with the count value of the counter 61 in each of the comparator circuits 62-1 to 62-256. As a result of the comparison, the data line driving signal (anode instruction signal) for each data line is obtained.

This operation will be described with reference to FIG. 3B in more detail. The counter 61 repeatedly counts up to a predetermined upper limit value in accordance with the clock signal CK. The upper limit value is set to a value corresponding to a time period of one scanning line SL. The outputs of the comparator circuits 62-1 to 62-256 rise to the high (H) level at the timing when a count value of the counter 61 is reset. Then, when the count value reaches the latched target count value, the output of the corresponding comparator circuit 62 drops to the low (L) level.

For example, if the target count value latched by a latch circuit 60-*x* is Dpw1, a comparison output ADT1 is obtained from the corresponding comparator circuit 62-*x*. In addition, if the target count value latched by a latch circuit 60-*y* is Dpw2, a comparison output ADT2 is obtained from the corresponding comparator circuit 62-*y*. Eventually, the comparator circuits 62-1 to 62-256 output pulses with the pulse widths corresponding to the gradation values of the display data, i.e., the target count values latched by the latch circuits 60-1 to 60-256, respectively.

Each comparison output as described above is supplied to the anode driver 33 as the data line driving signal (anode instruction signal) for each of the data lines DL1-DL256. During the ON-duty period of the pulse signal of each data line driving signal, the anode driver 33 outputs the constant current signal (anode driver output signal) to each of the data lines DL1 to DL256. For example, by turning on and off the current output of a constant current source according to the data line driving signal, the anode driver 33 outputs the anode driver output signal.

The foregoing is a basic operation of the timing controller 44 without considering the correction. In this embodiment, on a scanning line basis, the correction table generation circuit 57 creates a correction table for correcting the target count values (i.e., the time values corresponding to the gradation) corresponding to the display data to be applied to the pixels on the corresponding scanning line SL by using the look-up table storage unit 56, and stores it in the correction table storage unit 58. Then, a correction value (count correction value to be described below) corresponding to each pixel is read by the selector 59, and applied to the adder 55. The adder 55 arithmetically processes the target count value and the correction value, thereby correcting the target count value.

Figures 3B, 3C:
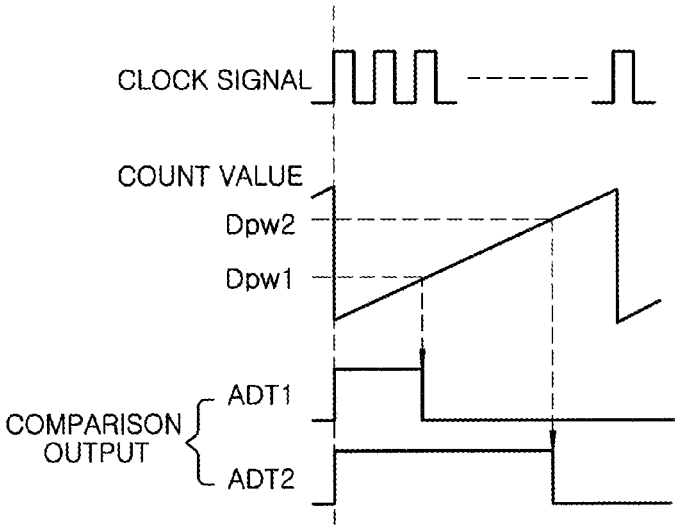

For the correction operation, a look-up table as shown in FIG. 3C is stored in the look-up table storage unit 56. In the look-up table, the number of gradation values is associated with a correction amount as shown in FIG. 3C. For reference, FIG. 3C also shows a pulse width correction amount corresponding to the correction amount, but it is not necessary to store it as the actual table data. The number of gradation values represents the number of display data having the same gradation in display data corresponding to the pixels on one scanning line.

The correction amount is a correction amount to be applied to the original target count value of the corresponding gradation value in accordance with the number of display data having the same gradation value. The correction amount is used for obtaining a count correction value which will be described later. The correction amount "1" corresponds to one count (=0.25 μs) of the target count value. The correction amount is stored as negative values such as "−4", "−8", . . . , "−24" as illustrated, which represent a reduction in the time period for which the constant current is applied to the data lines DL.

The pulse width correction amount is obtained by converting the correction amount into the correction amount to the pulse width of the data line driving signal. In other words, a negative correction amount becomes a reduction in the time period during which the constant current is actually applied. The correction operation using the look-up table will be described in detail later.

The number of gradation values and the correction amount in the look-up table are rewritable according to an instruction from, e.g., the MPU 2. For example, when the power is turned on, the MPU 2 transmits table data and a command signal for rewriting the look-up table to the controller IC 20. Further, the gradation table shown in FIG. 3A may be set by the MPU 2 such that the target count value can be calculated according to the gamma characteristics of the display unit 10, e.g., when the power is turned on. In this case, when the power is turned on, the look-up table as well as the gradation table may be set.

<Description on Luminance Changes Occurring in the Display>

The correction is performed as described above in the present embodiment, and the reason of the correction will now be mentioned.

Figure 4A:
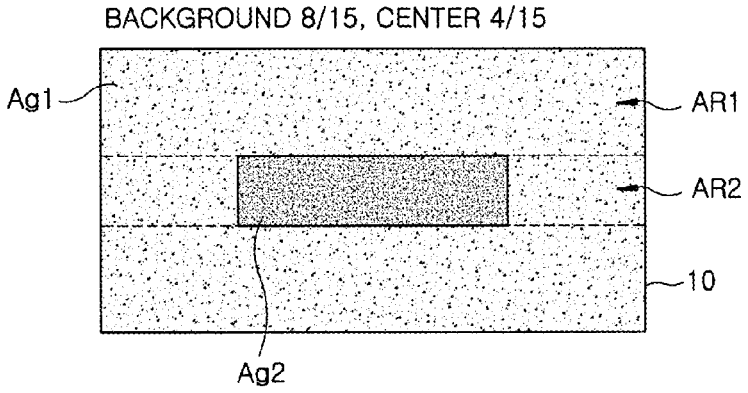
FIGS. 4A to 4C are diagrams for explaining a situation where a luminance variation occurs on the display image.

FIG. 4A shows an example of the display image on the display unit 10. In this example, the display is carried out by setting a background region Ag1 to the gradation value of 8/15 and a central region Ag2 to the gradation value of 4/15. For example, in the case where the central region Ag2 is set at a relatively low luminance and the background region Ag1 surrounding the central region Ag2 is set at a luminance of an intermediate gradation value, there may occur a phenomenon that an area AR1 and an area AR2 in the background region Ag1 of FIG. 4A have different gradations. That is, the luminance of the area AR2 (areas at the left and right side of the central region Ag2) defined by dashed lines may become higher than that of the other portion of the background region, which causes display unevenness. This phenomenon is caused by an overshoot of the data line driving signal (anode driver output signal) for the pixels in the area AR2.

Figure 4B:
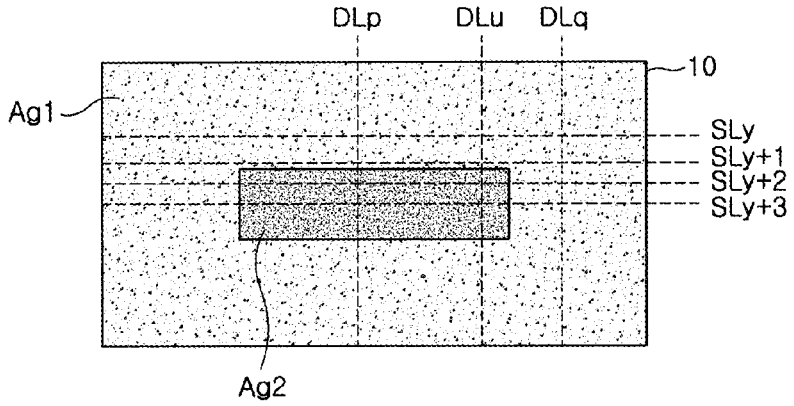
Figure 4C:
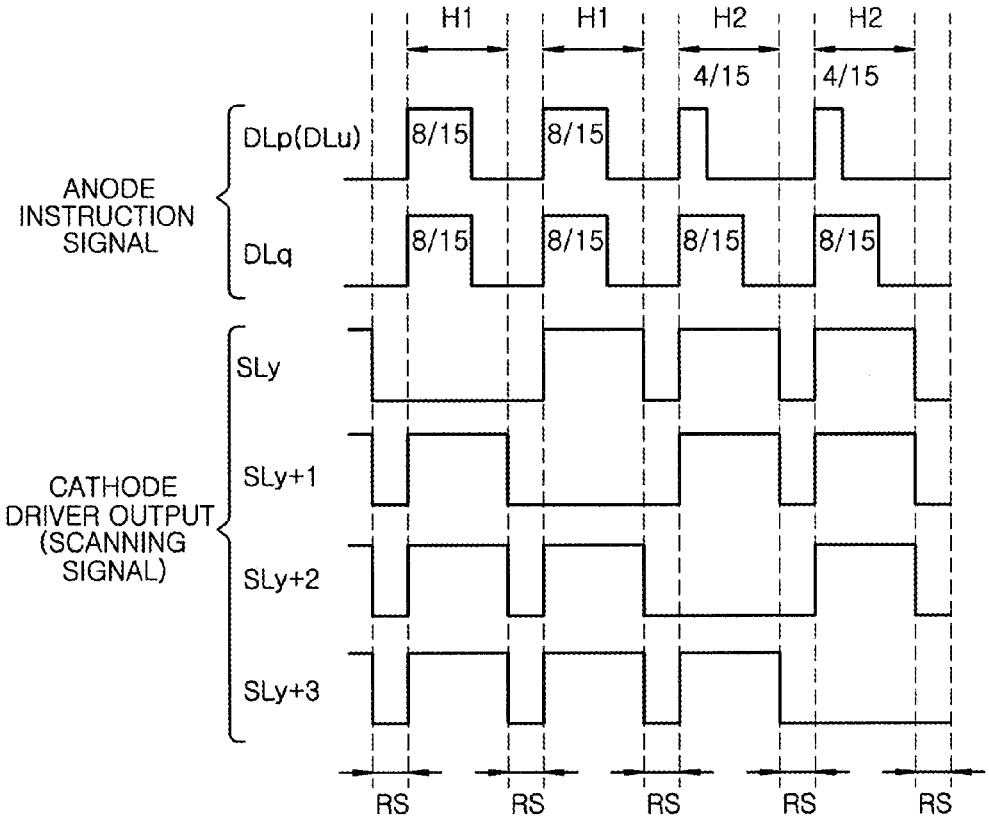

The overshoot will be explained. FIG. 4B schematically shows the four successive scanning lines SLy to Sly+3 and data lines DLp, DLu and DLq. Each of the scanning lines SLy and SLy+1 is a scanning line, all the pixels of which constitute the background region Ag1. Each of the scanning lines SLy+2 and SLy+3 is a scanning line, some pixels of which constitute the central region Ag2. Further, each of the data lines DLp and DLu is a data line including the pixels constituting the central region Ag2, and the data line DLq is a data line which does not include the pixels constituting the central region Ag2. FIG. 4C shows the data line driving signals (anode instruction signal) for the data lines DLp and DLq, and the scanning signals applied to the scanning lines SLy to SLy+3. Further, the data line driving signal for the data line DLu is the same as that for the data line DLp.

The scanning signal applied to each scanning line SL is a signal which has the L level when the corresponding scanning line SL is in a selected state. FIG. 4C shows a state where the scanning lines SLy to SLy+3 are selected sequentially for each time period corresponding to one scanning line SL. Further, during a period indicated by arrows RS, all the scanning signals are set at the L level. This period is a reset period in a driving method of a so-called cathode resetting method. In the cathode resetting method, when the scanning is switched from one scanning line to the next scanning line, all scanning lines are once connected to the reset potential, thereby reducing a delay of the start of the light emission of the pixels.

With regard to the anode instruction signal for the data line DLq, since all pixels connected to the data line DLq belong to the background region Ag1, a pulse signal with the pulse width corresponding to the 8/15 gradation value is applied to the respective pixels of the data line DLq when the scanning lines SLy to SLy+3 are selected, respectively. During the ON-duty period of the pulse signal, the constant current is applied to the data line DLq.

Meanwhile, the pixels connected to the data line DLp (and the data line DLu) include the pixels of the background region Ag1 and the central region Ag2. Accordingly, when the scanning lines SLy and SLy+1 are selected, a pulse signal with the pulse width corresponding to the 8/15 gradation value is applied to the data line DLp as the anode driver output signal, and when the scanning lines SLy+2 and SLy+3 are selected, a pulse signal with the pulse width corresponding to the 4/15 gradation value is applied to the data line DLp as the anode driver output signal.

Figure 5:
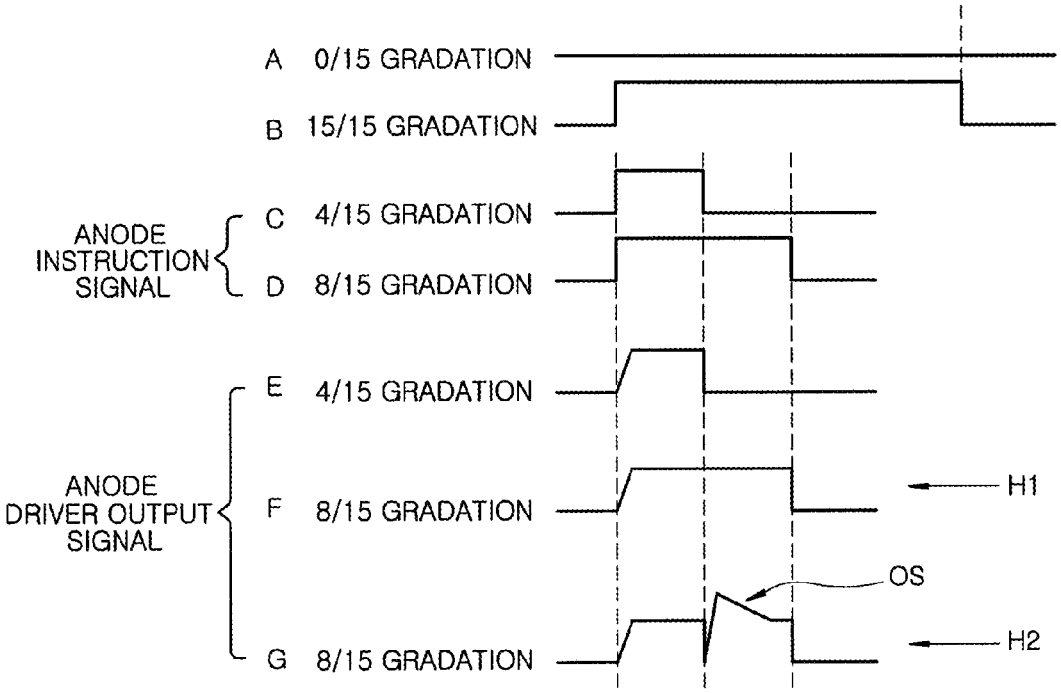
FIG. 5 is a diagram for explaining an overshoot which causes a luminance variation.

FIG. 5 shows the data line driving signals for the data lines DL. For reference, A and B of FIG. 5 illustrate pulse waveforms as data line drive signals in the case of the gradation value of 0/15 and 15/15, respectively. In FIG. 5, C shows the anode instruction signal corresponding to the 4/15 gradation value for the pixels in the central region Ag2 of the data lines DLp and DLu in FIGS. 4C, and D shows the anode instruction signal corresponding to the 8/15 gradation value for the pixels in the background region Ag1 of the data lines DLp, DLu and DLq in FIG. 4C.

In response to the anode instruction signal C of FIG. 5, the anode driver output signal as designated by E of FIG. 5 is applied to the data lines DL. Further, in response to the anode instruction signal D of FIG. 5, the anode driver output signal as designated by F of FIG. 5 is applied to the data lines DL. In addition, in the waveforms of the anode driver output signals E and F of FIG. 5, the rising edge is inclined, which is considered due to an influence of the wiring capacitance of the data lines.

In FIG. 5, G shows another example of the anode driver output signal corresponding to the anode instruction signal D of FIG. 5 similarly to the anode driver output signal F of FIG. 5. However, the waveform (potential of the data line) of the anode driver output signal G is once decreased, and an overshoot OS occurs as a reaction thereof. The waveform of the anode driver output signal F of FIG. 5 corresponds to the waveform of the anode driver output signal for the time period H1 in the anode instruction signal of FIG. 4C, and the waveform of the anode driver output signal G of FIG. 5 corresponds to the waveform of the anode driver output signal for the time period H2 in the anode instruction signal of FIG. 4C.

That is, the anode driver output signal (potential of the data line) of the 8/15 gradation value of the data lines DLp, DLu and DLq in the H1 period of FIG. 4C becomes the waveform of the anode drive output signal F of FIG. 5, and the anode driver output signal (potential of the data line) of the 8/15 gradation value of the data line DLq in the H2 period of FIG. 4C becomes the waveform of the anode drive output signal G of FIG. 5. Thus, in the anode driver output signals applied to the pixels in the area AR2 of FIG. 4A, the overshoot OS occurs as shown in G of FIG. 5. As a result, the luminance of the area AR2 becomes higher than its original luminance due to the overshoot OS, which is visually recognized as display unevenness.

Figure 6A:
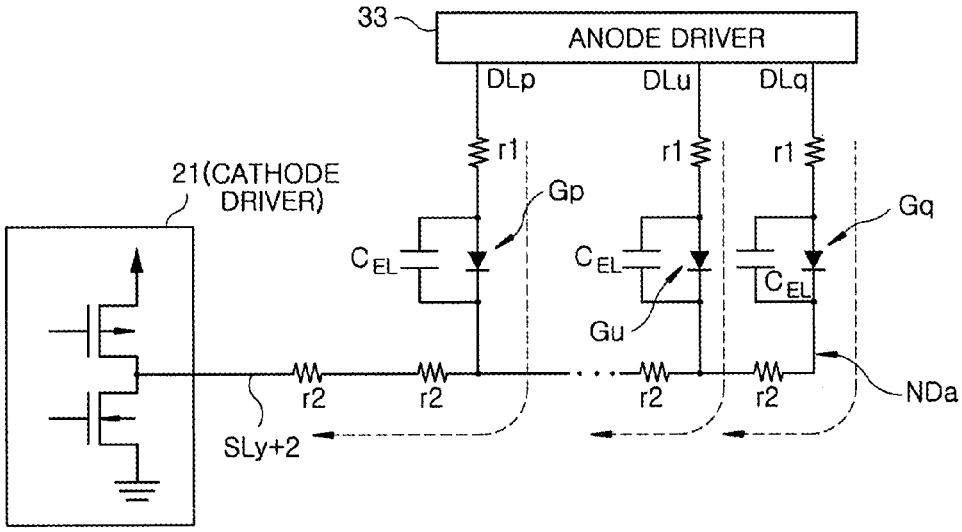
FIGS. 6A to 6E are diagrams for explaining a cause of luminance variation.
Figure 6B:
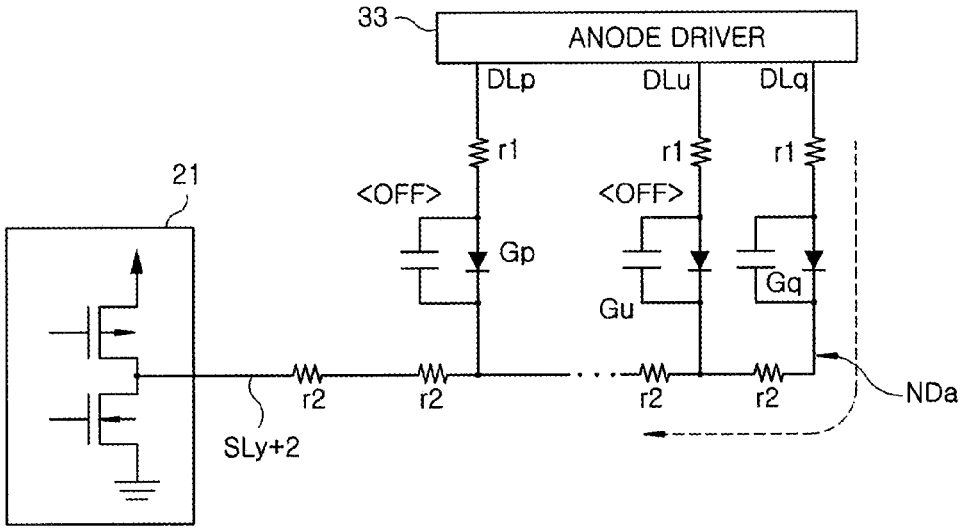

The overshoot OS occurs for the following reason. FIGS. 6A and 6B schematically show equivalent circuits of the data lines DLp, DLu and DLq, the scanning line SLy+2, and pixels Gp, Gu and Gq at the intersections thereof. In the figures, organic EL pixels are indicated by a diode symbol. Also, a wiring resistance component r1 of the data lines DL, a wiring resistance component r2 of the scanning lines SL, and a parasitic capacitance CEL of the organic EL pixels Gp, Gu and Gq are represented.

During the H2 period, the state of FIG. 6A is changed to the state of FIG. 6B. In the first half of the H2 period, as shown in FIG. 6A, all the data lines DLp, DLu and DLq are driven at a constant current, and a current flows as shown by dashed-line arrows in FIG. 6A. For pixels of the 4/15 gradation value and the 8/15 gradation value, the length of the time period of applying the current is different (see C and D of FIG. 5). Thus, in the second half of the H2 period, as shown in FIG. 6B, the current flows (indicated by a dashed-line arrow) through the data line DLq on which the pixels are driven at the 8/15 gradation value, but no current flows (indicated by <OFF>) through the data lines DLp and DLu on which the pixels are driven at the 4/15 gradation value.

Figure 6C:
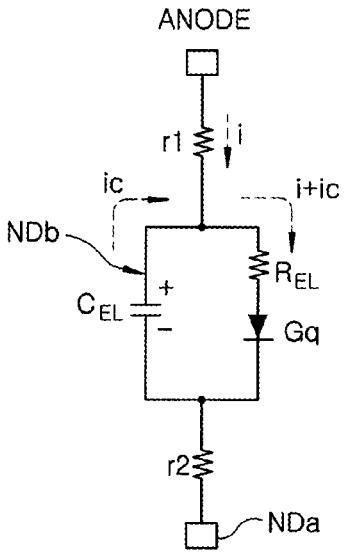
Figure 6D:
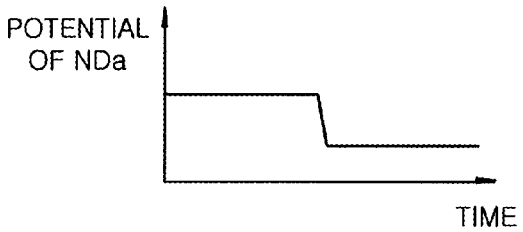
Figure 6E:
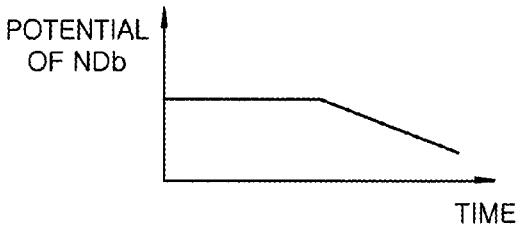

During the H2 period, the potential of a point NDa in FIG. 6B is dropped as shown in FIG. 6D. In other words, the current flowing through the scanning line SLy+2 decreases when a transition is made to the state of FIG. 6B from the state of FIG. 6A, and thus the potential of the point NDa decreases. FIG. 6C shows the more specific equivalent circuit of the pixel Gq having the parasitic capacitance $C_{EL}$ and the internal resistance $R_{EL}$. When the potential of the point NDa drops, the parasitic capacitance $C_{EL}$ starts to discharge (discharge current ic). By this discharge, the potential of the point NDb decreases as shown in FIG. 6E.

Meanwhile, the discharge current ic flows to the organic EL element from the point NDb, and the anode current i and the discharge current ic flow in the organic EL element. Thus, the potential increase (overshoot OS) as the anode driver output signal occurs, and the pixel Gq emits light temporarily at a luminance higher than the luminance of the original gradation. In other words, each pixel of the area AR2 of FIG. 4A has a luminance higher than the original background gradation value, which may cause display unevenness.

As a result, if the pixels driven at different gradation values are present in the same line and when the driving of the pixels of the relatively low gradation value are turned off while the driving of the pixels of the relatively high gradation value are turned on, the variations in the light emission luminance occur due to an influence on the waveform of driving the pixels of the relatively high gradation value immediately after the turning-off of the pixels of the relatively low gradation value. The magnitude of the influence depends on the number of pixels to be driven at the relatively low gradation value. This is because a change in the current value becomes greater as the number of pixels which make the transition from the turn-on state to the turn-off state becomes larger.

<Correction Process>

In order to eliminate the display unevenness occurring as described above, in the present embodiment, the corrected data line driving signal is in advance applied to the pixels which otherwise will emit light at a luminance higher than the original gradation value. The correction process will be described with reference to FIGS. 7A to 8D. The correction is performed to display data for pixels of one scanning line on a scanning line basis.

Figures 7A, 7B:
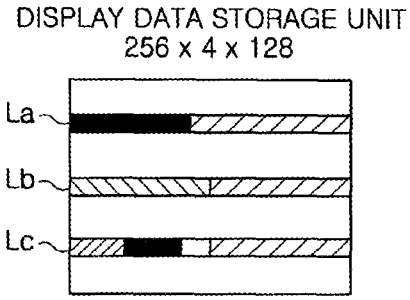

For example, FIG. 7A schematically shows the image data of one frame. In the display data storage unit 32 shown in FIG. 2A, the display data of one frame are stored. The display data of one frame are data of, e.g., 256 columns×128 rows×4 bits. The display data of one frame are put into the buffer 52 of the timing controller 44 shown in FIG. 2B on a scanning line basis, and the display data are supplied to the selector 53 on a dot basis (1 dot=1 pixel=4 bits). Thus, as described above, the target count value corresponding to the gradation value of each pixel of one scanning line is outputted from the selector 53.

In parallel with this operation, the correction table generation circuit 57 creates the correction table and stores it in the correction table storage unit 58. For example, FIG. 7A schematically shows lines La, Lb and Lc in one frame, and the correction table is created for the display data of each line.

In order to create the correction table, first, the correction table generation circuit 57 counts the number of display data which has the same gradation value in the display data for one scanning line. Specifically, the correction table generation circuit 57 checks gradation values of the display data for 256 pixels of one scanning line stored in the buffer 52, and counts the number of display data which has the respective gradation values in one scanning line. For example, among the display data of 256 pixels of the line La shown in FIG. 7A, the display data of 146 pixels have the 8/15 gradation value, and the display data of 110 pixels have the 2/15 gradation value. Thus, a table of the number of gradation values as shown in FIG. 7B is created.

Then, the correction table generation circuit 57 calculates a correction amount corresponding to each of the numbers of gradation values from the counting result (table of the number of gradation values) of FIG. 7B by referring to the look-up table of, e.g., FIG. 3C. As shown in FIG. 7B, since the number of display data of the 2/15 gradation value is 110, the correction amount "−8" (corresponding to −2 μs of the pulse width correction amount) is obtained with reference to the look-up table of FIG. 3C. Further, since the number of display data of the 8/15 gradation value is 146, the correction amount "−12" (corresponding to −3 μs of the pulse width correction amount) is obtained from the look-up table of FIG. 3C.

Further, the correction table generation circuit 57 creates the correction table by using the calculated correction amount. The correction table includes the gradation values and the count correction values corresponding thereto, respectively, as shown in, e.g., FIGS. 7E and 7F. The count correction value is a value indicating the correction amount for the target count value. In practice, the correction table may be constituted by 4-bit binary data representing the gradation values and the count correction values corresponding to the respective gradation values. In FIGS. 7E and 7F, the column of the gradation value includes 4-bit binary data in practice. Also, the pulse width correction amount corresponding to the count correction value is shown In FIGS. 7E and 7F, but it is shown for reference and does not need to be stored as the correction table.

In the present embodiment, the correction table generation circuit 57 does not directly use a correction amount obtained from the look-up table based on the number of each gradation value as the count correction value for the corresponding gradation value, but uses it as a correction amount (count correction value) of a gradation value higher than the corresponding gradation value. As described above, this is because if the pixels driven at different gradations are present in the same scanning line and when the driving of the pixels of the relatively low gradation is turned off while the driving of the pixels of the relatively high gradation is turned on, the turning-off of the pixels of the relatively low gradation affects the waveform of the pixels of the relatively high gradation immediately after the turning-off and a variation in light emission luminance occurs.

Specifically, in the case of the counting result shown in FIG. 7B, the correction amount "−8" for the 2/15 gradation value is set as the count correction value for the 8/15 gradation value. In this case, since no gradation value higher than the 8/15 gradation value is present, the correction amount "−12" for the 8/15 gradation value is not used. Accordingly, the correction table as shown in FIG. 7E is created. This table has only the count correction value "−8" for the 8/15 gradation value. For the 2/15 gradation value, since a display data of a gradation value lower than the 2/15 gradation value does not exist, the correction is not performed (count correction value=0).

The same applies to the line Lb in FIG. 7A. For example, a table of the number of each gradation value shown in FIG. 7C is obtained by counting the number of display data for each of the gradation values, and the correction amount for each gradation value is acquired from the look-up table. Although not shown, in this case, there is created a correction table in which the correction amount "−12" for the 6/15 gradation value is set as the count correction value for the 12/15 gradation value which is higher than the 6/15 gradation value.

The line Lc of FIG. 7A is an example of a scanning line in which four different gradation values exist. As a result of counting the number of display data for each of the gradation values, a table of the number of each gradation value as shown in FIG. 7D is created. Since the number of display data for the 1/15 gradation value is 60, the correction amount "−4" (equivalent to −1 μs) is obtained from the look-up table. Further, the correction amount "−4" for the 8/15 gradation value, the correction amount "−8" for the 10/15 gradation value, and the correction amount "0" for the 13/15 gradation value are obtained, respectively.

The correction table is created as shown in FIG. 7F based on the above. More specifically, the correction amount for the 1/15 gradation value is set as the correction amount to the 8/15 gradation value, and the count correction value for the 8/15 gradation value becomes "−4" (equivalent to −1 μs). For the 10/15 gradation value, the sum of the correction amount "−4" for the 1/15 gradation value and the correction amount "−4" for the 8/15 gradation value, i.e., "−8" (equivalent to −2 μs) is set as the count correction value. For the 13/15 gradation value, the sum of the correction amount "−4" of the 1/15 gradation value, the correction amount "−4" of the 8/15 gradation value and the correction amount "−8" of the 10/15 gradation value, i.e., "−16" (equivalent to −4 μs) is set as the count correction value. For the 1/15 gradation value, since a display data of a gradation value lower than the 1/15 gradation value does not exist, the correction is not performed (count correction value=0).

The correction table is created in this way for each of the scanning lines, and stored in the correction table storage unit 58 of FIG. 2B. Then, actual correction is performed as follows. Similarly to the selector 53, the display data of four bits is sequentially supplied to the selector 59. Accordingly, the selector 59 reads the count correction value corresponding to the gradation value of 4 bits from the correction table stored in the correction table storage unit 58, and outputs it to the adder 55. Thus, the adder 55 performs the addition of the target count value and the count correction value as a correction calculation.

For example, it assumed that, currently, the correction process is performed on the line Lc, and the correction table of FIG. 7F is stored in the correction table storage unit 58. In this case, when 4-bit data "1000" (=8/15 gradation value) is supplied as a display data for a pixel to the selectors 53 and 59 from the buffer 52, the selector 53 reads "80" as the target count value for the 8/15 gradation value from the gradation table (see FIG. 3A), and the selector 59 reads "−4" as the count correction value for the 8/15 gradation value from the correction table (see FIG. 7F). Then, the target count value "80" and the count correction value "−4" are added by the adder 55, and the target count value is corrected to "76."

As described above, the target count value is corrected by the count correction value and sent to the corresponding latch circuit 60. The comparator circuit 62 compares the target count value with the count value of the counter 61 to produce the data line driving signal. Here, the data line driving signal is corrected to have a reduced pulse width as a result of the correction process for the target count value. If the correction table as shown in, e.g., FIG. 7F is created, the pulse width of the data line driving signal corresponding to each of the gradation values is corrected as shown in FIG. 8A. More specifically, the pulse width of the driving signal for the 8/15 gradation value is corrected from 20 μs to 19 μs, the pulse width of the data line driving signal for the 10/15 gradation value is corrected from 30 μs to 28 μs, and the pulse width of the data line driving signal for the 13/15 gradation value is corrected from 60 μs to 56 μs.

Figure 8B:
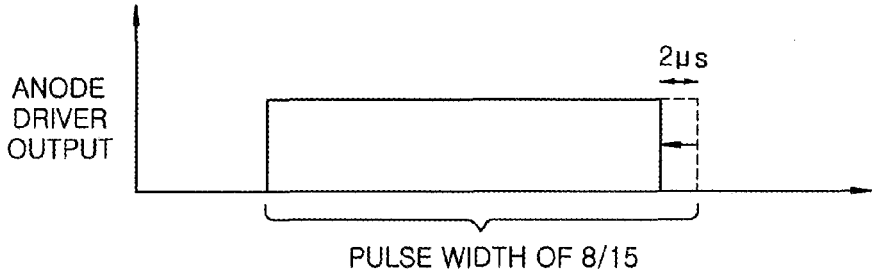
Figure 8C:
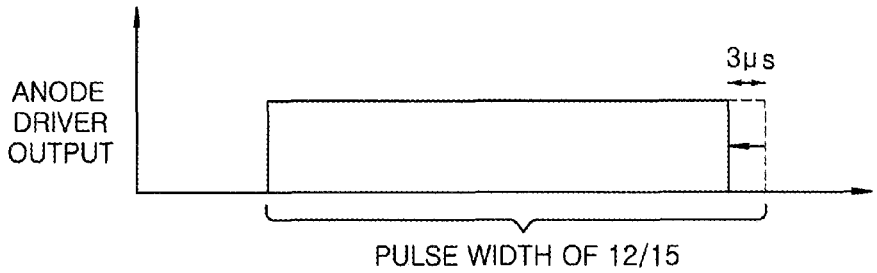

FIGS. 8B and 8C illustrate states where the constant current outputted as the data line driving signal (anode driver output signal) is reduced by the correction. For example, in the case of the line La shown in FIG. 7A, the pulse width of the data line driving signal of the 8/15 gradation value is reduced by 2 μs as shown in FIGS. 7B and 7E. Accordingly, when driving the data lines for the pixels of the 8/15 gradation value, as shown in FIG. 8B, the pulse width of the anode driver output signal is shortened by 2 μs from the original pulse width of the driving signal for the 8/15 gradation value (20 μs in FIG. 3A). Further, in the case of the line Lb shown in FIG. 7A, the pulse width of the data line driving signal of the 12/15 gradation value is reduced by 3 μs as shown in FIG. 7C. Accordingly, when driving the data lines for the pixels of the 12/15 gradation value, as shown in FIG. 8C, the pulse width of the anode driver output signal is reduced by 3 μs from the original pulse width of the driving signal for the 12/15 gradation value (50 μs in FIG. 3A).

With the correction as described above, the increase in the luminance of pixels which may cause the aforementioned luminance increase is suppressed. In other words, even though the overshoot OS occurs, the increase in luminance due to the overshoot OS is suppressed by the correction, thereby eliminating or reducing the display unevenness on the display image.

Figure 8D:
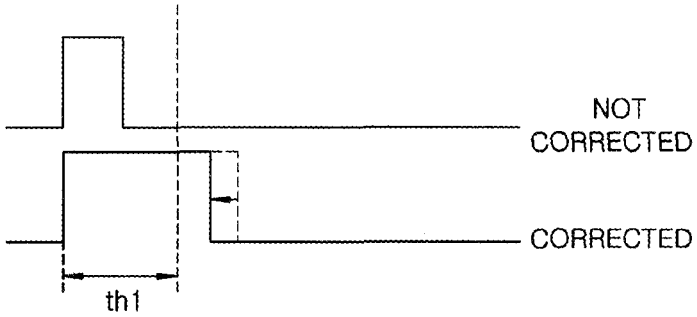

Further, in the present embodiment, when the target count value is small and the pulse width is small, no correction is performed. As shown in FIG. 8D, the correction is not performed when the pulse width of the data line driving signal is narrower than a predetermined threshold value th1, and the correction is performed when it is wider than the predetermined threshold value th1. When the predetermined threshold value th1 is, e.g., 10 μs, the target count values of the 2/15 gradation value, the 1/15 gradation value and the 0/15 gradation value are excluded from the correction. Thus, in the case of the gradation in which a time period for applying current is originally short, shortening the time period for applying current is restricted. Further, in the present embodiment, when a target count value for a gradation value is decreased by the correction, the correction amount is limited such that the corrected target count value becomes greater than a target count value for a gradation value immediately below the corresponding gradation value.

A process for realizing the correction operation described above, particularly, a process of the correction value generating unit 44*a* will be described with reference to FIGS. 9, 10 and 11. This is mainly a process performed by the correction table generation circuit 57.

Figure 9:
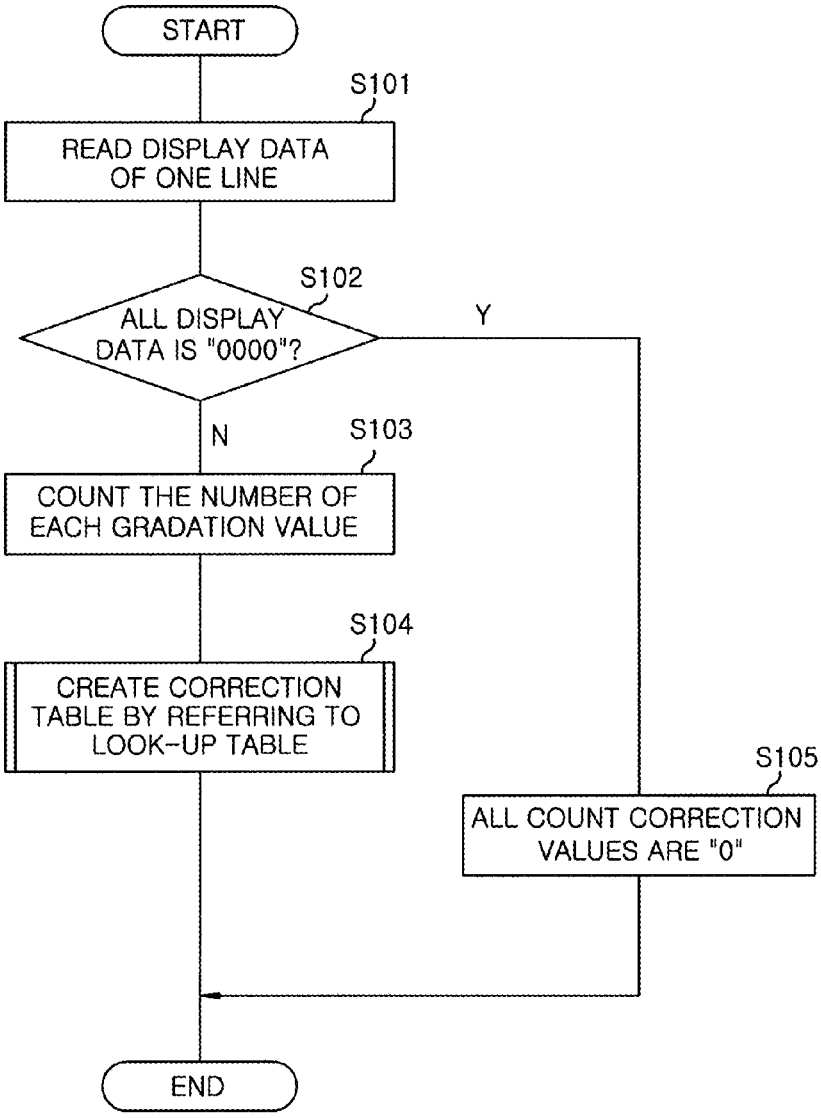
FIGS. 9 to 11 are flowcharts of a correction table creation process in accordance with the embodiment.

In step S101 of FIG. 9, the correction table generation circuit 57 reads the display data of one line from the buffer 52. Since it is not necessary to perform the correction if all the display data of one scanning line is "0000", the correction table generation circuit 57 proceeds to step S105 from step S102 to create a correction table in which all of the count correction values are "0". That is, in the correction table of the correction table storage unit 58, "0" is written as a count correction value corresponding to each gradation value (4-bit binary data), and this table is set as a correction table for the corresponding scanning line.

In the case where there is a display data other than the gradation value "0000" in display data of one scanning line, the correction table generation circuit 57 proceeds to step S103 from step S102 to count the number of display data for each of the gradation values in the scanning line. Accordingly, the number of the display data for each gradation value is counted, and a table of the number of each gradation value as illustrated in FIG. 7B, 7C or 7D is created. Then, in step S104, by referring to a look-up table, the correction table is created as described above.

Figure 10:
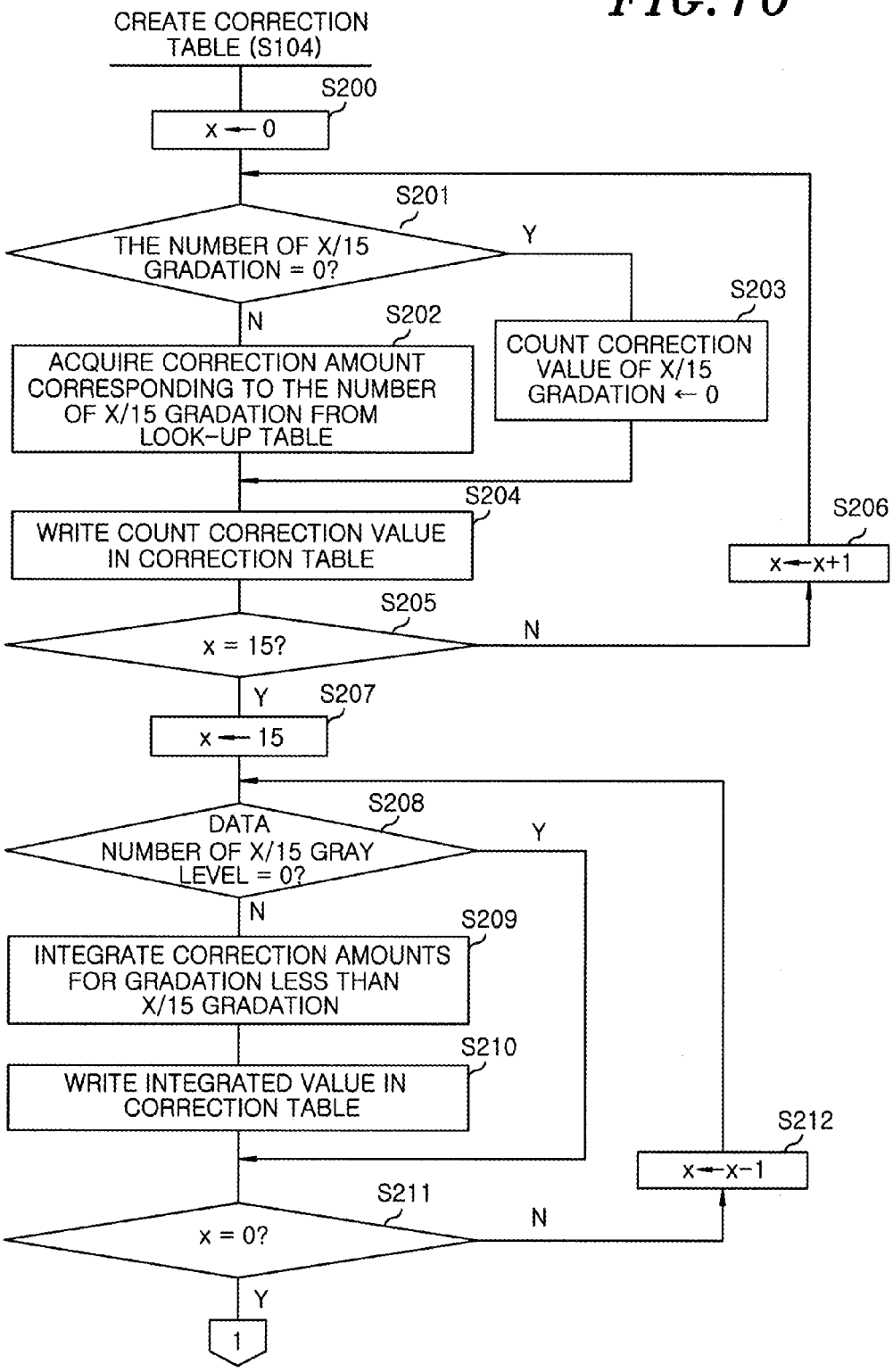
Figure 11:
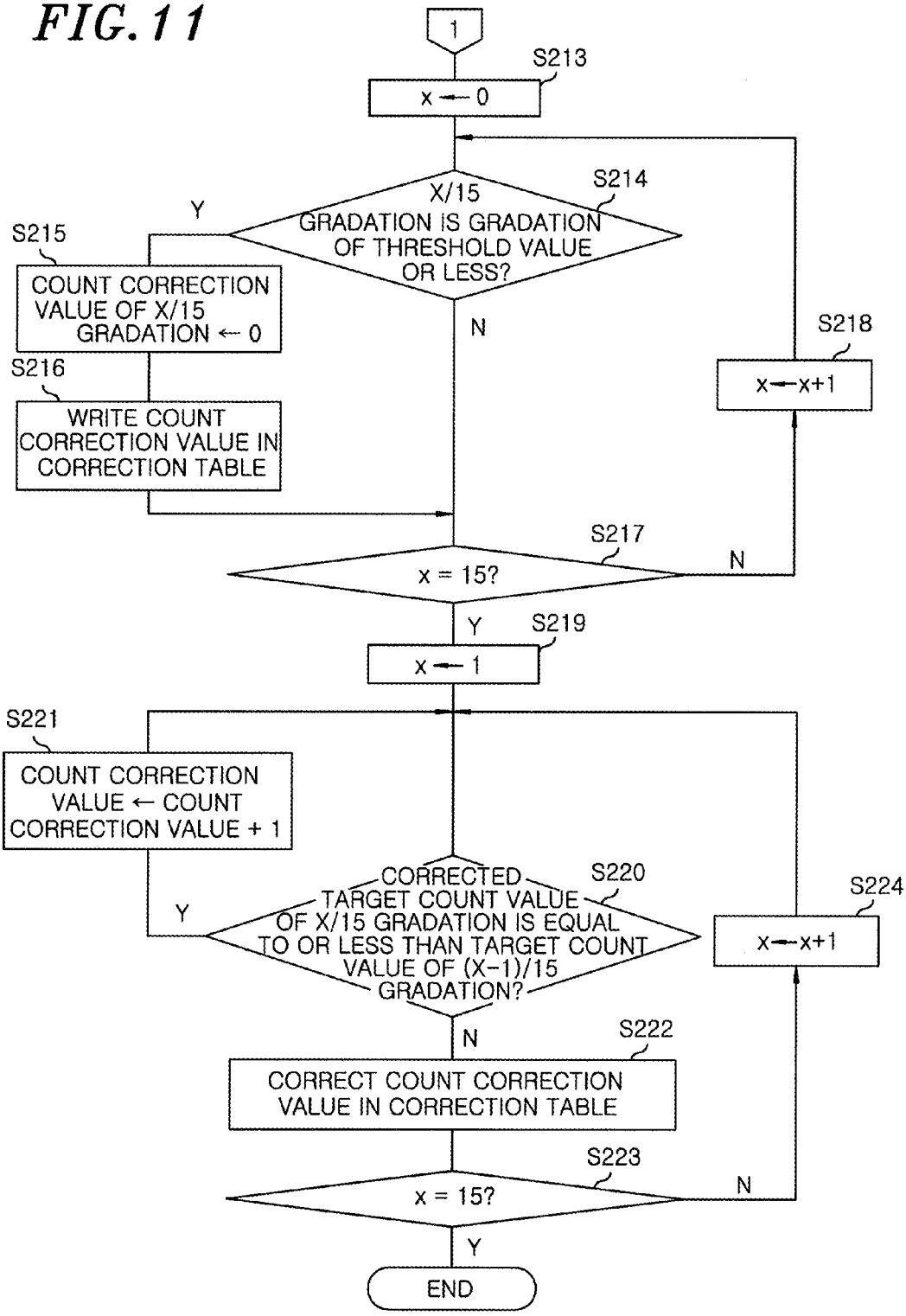

A specific processing example of step S104 is shown in FIGS. 10 and 11. The process of FIGS. 10 and 11 includes, in addition to the process of setting the count correction value for the target count value of each gradation value based on the counting result of the number of each gradation value, the process of restricting correction for a gradation value if a pulse width of a data line driving signal for the gradation value is equal to or less than the predetermined threshold value, and the process of limiting the correction amount for a target count value of a gradation value such that the corrected target count value of the gradation value becomes greater than a target count value of a gradation value immediately below the gradation value.

In steps S200 to S206 of FIG. 10, based on the table of the gradation value number obtained in step S103, the correction amount corresponding to each gradation value number is acquired from the look-up table (see FIG. 3C). First, the correction table generation circuit 57 resets a variable x to zero in step S200. The variable x is a variable for performing the process sequentially for 0/15 to 15/15 gradation values. Then, the process of steps S201 to S204 is performed on each of the gradation values which are sequentially specified by increasing the variable x.

In step S201, the correction table generation circuit 57 checks the number of display data having the x/15 gradation value with reference to the counting result stored in the table of the number of each gradation value. If the number of display data for the x/15 gradation value is not "0", the process proceeds to step S202 to acquire the correction amount corresponding to the number of display data from the look-up table. Then, in step S204, the correction amount is temporarily written as a count correction value corresponding to the x/15 gradation value in the correction table.

Further, in this step, the count correction value (correction amount obtained from the look-up table) to be written in the correction table is not a final count correction value. In step S204, the value of the correction amount shown outside the tables in the examples of FIGS. 7B, 7C and 7D is temporarily stored in a storage area reserved for the correction table. Accordingly, the storage area reserved for the correction table is effectively utilized in storing the correction amount.

If the number of display data is determined as "0" in step S201, the process proceeds to step S203, and "0" is set as the count correction value for the x/15 gradation value. This is because it is not necessary to acquire the correction amount from the look-up table if the number of display data is "0". Then, in step S204, the count correction value (=0) is written as the count correction value corresponding to the x/15 gradation value in the correction table.

In step S205, it is determined whether the variable x is 15, i.e., whether the process of acquiring the correction amount from the look-up table has been completed for all gradation values. If the variable x is not 15, the variable x is incremented in step S206 and the process of step S201 to step S204 is repeated. Upon completing the correction amount acquisition for all gradation values, the process proceeds to step S207 from step S205.

In steps S207 to S211, the correction table generation circuit 57 performs a process of writing a count correction value in the correction table. As described above, at this point, the correction amount (or "0") obtained from the look-up table is temporarily stored as a count correction value for each gradation value in the correction table. Then, the final count correction value for a gradation value is obtained by calculating the sum of one or more correction amounts temporarily stored for one or more gradation values lower than the corresponding gradation value. In other words, as described with reference to FIGS. 7E and 7F, the final count correction value for each gradation value is an integrated value of the correction amounts for gradation values less than the corresponding gradation value. The process of setting the count correction value as the integrated value is performed in step S207 to step S212.

The correction table generation circuit 57 sets the variable x=15 in step S207. Then, the process of steps S208 to S210 is performed on the respective gradation values which are sequentially specified by the variable x. In this case, the process is performed in the order of the 15/15 gradation value to the 0/15 gradation value.

In step S208, the correction table generation circuit 57 checks the number of display data for the x/15 gradation value stored in the table of the number of each gradation value. If the number of display data for the x/15 gradation value is "0", the final count correction value for the x/15 gradation value is "0". At this point, 0 is already written as the count correction value in the correction table (see the process of step S203→S204). Thus, rewriting of the count correction value in the correction table is unnecessary, and the process proceeds to step S211.

If the number of display data for the x/15 gradation value is not "0" in step S208, i.e., if there is a possibility of performing the correction to the display data for the x/15 gradation value, the process proceeds to step S209, and the count correction value is set for the x/15 gradation value. Specifically, in step S209, the correction table generation circuit 57 obtains the sum of the correction amounts for any gradation values lower than the x/15 gradation value, which are already obtained from the look-up table. That is, the correction table generation circuit 57 integrates the correction amounts (see the process of steps S202 and S204) stored as the temporal count correction values in the correction table, with respect to the respective gradation values lower than the x/15 gradation value.

Then, in step S210, the integrated value is finally written as a count correction value for the x/15 gradation value in the correction table. Specifically, the integrated value is overwritten to the value of the correction amount (value of the correction amount obtained from the look-up table) that has been temporarily stored as the count correction value for the x/15 gradation value in the correction table. For that reason, the process of steps S208 to S210 is performed sequentially from the 15/15 gradation value and the temporarily stored correction amount for the x/15 gradation value is not used in the process for obtaining a count correction value for a gradation value lower than the x/15 gradation value.

In step S211, the correction table generation circuit 57 determines whether the variable x is 0, i.e., whether the process for obtaining the count correction value is completed for all gradation values. If the variable x is not 0, the variable x is decremented in step S212 and the process proceeds to step S208. Thus, the process of steps S209 and S210 is performed for the other gradation values. That is, after the process of steps S208 to S210 is performed first for the 15/15 gradation value, the process of steps S208 to S210 is performed sequentially for the 14/15 gradation value, the 13/15 gradation value . . . .

Further, in the case of the 0/15 gradation value, since a gradation value lower than the 0/15 gradation value is not present and the integrated value is 0, the count correction value for the 0/15 gradation value is written as "0" in the correction table even if the number of display data for the 0/15 gradation value was not "0". In other words, regardless of whether the number of display data for the 0/15 gradation value is "0" or not, the count correction value is set to be 0. When the process for the 0/15 gradation value is completed, it is determined that the variable x is 0 in step S211. At this point, the count correction values for all gradation values are written in the correction table, so the process proceeds to step S213 in FIG. 11 from step S211 in FIG. 10.

In steps S213 to S218, the correction table generation circuit 57 performs the process of restricting the correction of a gradation value equal to or less than the predetermined threshold value.

Specifically, the correction table generation circuit 57 sets the variable x=0 in step S213. In step S214, the correction table generation circuit 57 determines whether the x/15 gradation value is a gradation value corresponding to the pulse width equal to or less than the predetermined threshold value th1 as described in FIG. 8D. In other words, it is determined whether the x/15 gradation value needs to be excluded from the correction. If it needs to be excluded, the process proceeds to step S215 and the count correction value for the x/15 gradation value is set to zero so as not to execute the correction of the x/15 gradation value. Then, in step S216, the count correction value corresponding to the x/15 gradation value is written in the correction table. Accordingly, the count correction value for the x/15 gradation value is rewritten as "0" in the correction table.

In step S217, it is determined whether the variable x is 15, i.e., whether the process is completed for all gradation values. If the variable x is not 15, the variable x is incremented in step S218, and the process from step S214 is repeated.

By the process of steps S213 to S218, the count correction value is forcibly updated to "0" for the gradation values equal to or less than the gradation value corresponding to the pulse width of the predetermined threshold value th1. For example, if the gradation values equal to or less than the gradation value corresponding to the pulse width of the predetermined threshold value th1 are the 2/15 gradation value, the 1/15 gradation value and the 0/15 gradation value, the process of steps S215 and S216 is performed for the cases where the variable x=0, 1, 2, and the count correction values for these gradation values are rewritten as "0" in the correction table. The count correction value=0 means that the correction is not performed for the gradation value associated therewith.

When the above process for all gradation values is completed and it is determined that the variable x=15 in step S217, the process proceeds to step S219.

In steps S219 to S224, the correction table generation circuit 57 performs a process of restricting the corrected target count value for the x/15 gradation value to be larger than a target count value for a gradation value immediately below the x/15 gradation value. That is, the process (gradation compensation) of limiting the correction amount (count correction value) is performed on the x/15 gradation value such that the corrected target count value for the x/15 gradation value does not become equal to or less than a target count value for a gradation value immediately below the x/15 gradation value.

Specifically, the correction table generation circuit 57 sets the variable x=0 in step S219. In step S220, the correction table generation circuit 57 checks whether the value obtained by correcting the target count value for the x/15 gradation value using the count correction value is equal to or less than a target count value for the (x−1)/15 gradation value. For the target count value, the correction table generation circuit 57 may refer to the gradation table. If it is equal to or less than the target count value for (x−1)/15 gradation value, the correction table generation circuit 57 adds 1 to the count correction value for the x/15 gradation value in step S221.

Since the correction amount and the count correction value are negative values as described above, addition of +1 means that the correction amount as the count correction value is reduced by one count. Then, the process returns to step S220, and it is checked whether a value obtained by correcting the target count value for the x/15 gradation value using the count correction value corresponding to the reduced correction amount is equal to or less than the target count value for the (x−1)/15 gradation value.

As the above, in steps S220 and S221, when the corrected target count value for the x/15 gradation value is equal to or less than the target count value of the target count value for the (x−1)/15 gradation value, the count correction value is adjusted (the correction amount is limited) such that the corrected target count value is one count larger than the target count value for the gradation value immediately below the corresponding gradation value.

When the adjustment of the count correction value is completed through step S221, the correction table generation circuit 57 proceeds to step S222 and corrects the count correction value for the x/15 gradation value in the correction table by the adjusted count correction value. If it does not proceed to step S221, i.e., if the adjustment process is unnecessary for the count correction value of the x/15 gradation value, the correction to the count correction value of the correction table is not substantially performed in step S222.

In step S223, it is determined whether the variable x is 15, i.e., whether the adjustment process of the target count value has been completed for all gradation values. If the variable x is not 15, the variable x is incremented in step S224, and the process from step S220 is repeated. The process is terminated if the variable x is 15.

The process of FIGS. 10 and 11 is executed in step S104 of FIG. 9. At the end of the process of FIG. 9, the correction table for the subject scanning line to be displayed is held in the correction table storage unit 58. Then, as described above, the target count value and the count correction value are read for each pixel by the selectors 53 and 59, and the correction of the target count value is performed by the adder 55.

<Summary and Modification>

In the embodiment as described above, the controller IC (display driver) drives the data lines DL of the display unit 10 according to the gradation values of the pixels and has the correction value generating unit 44*a* and the driving signal generating unit 44*b*. The correction value generating unit 44*a* counts the number of display data for each gradation value in display data corresponding to pixels on one scanning line SL, obtains the correction value (count correction value) for the display data of each gradation value in accordance with the counting result, thereby generating the correction table.

The driving signal generating unit 44*b* performs the correction process to the target count value using the count correction value stored in the correction table. Further, the driving signal generating unit 44*b* generates the data line driving signal for driving each of the data lines DL based on the display data (target count values obtained through the adder 55) after the correction process. By performing such a correction, it is possible to eliminate or reduce the luminance unevenness on the display and to improve the display quality.

In particular, as described above, a signal applied to a pixel may overshoot due to an influence of light emission gradations or the number of other light emitting pixels on the same line. In the present embodiment, display data to be corrected and the correction amount are determined according to the number of display data for each gradation value in the display data corresponding to the pixels on one scanning line. Thus, the correction of the data line driving signal for the pixels which may cause the luminance unevenness can be performed appropriately. Specifically, it is possible to perform the correction for reducing the luminance of the pixel for which anode driver output signal overshoots, thereby effectively eliminating or reducing the luminance unevenness. In other words, even if the overshoot occurs, it is possible to realize a display with the luminance of the original gradation value by correcting the anode driver output signal in response thereto.

Further, the correction value generating unit 44*a* obtains the correction amounts for the respective gradation values according to the number of display data for each gradation value, and generates count correction values for the respective gradation values by applying the correction amounts for the respective gradation values to the count correction values for the respective upper gradation values. As described above, the variation of the luminance due to the overshoot affects a display area of the upper gradation value according to the number of display data of the lower gradation values on the same line. Therefore, an appropriate correction operation is realized by using the correction amount for each gradation value obtained according to the number of display data for each gradation value to obtain a correction amount (count correction value) for the upper gradation value.

In the present embodiment, the correction value generating unit 44*a* generates a correction value according to the counting result of the number of display data for each gradation value by using the look-up table showing the correspondence between the correction amount and the number of display data for each gradation value. By storing the number of display data for each gradation value and the correction amount corresponding thereto in the look-up table, the correction amount corresponding to the number of display data for each gradation value can be obtained by referring to the look-up table.

Thus, it is possible to remarkably facilitate the arithmetic processing for determining the correction amount and realize high-speed processing. Further, it is suitable for the process that creates correction tables sequentially on a scanning line basis. Since a correction table can be generated at a high speed with the simple circuit as the above, the process can be performed in synchronization with each line scanning in the sequential driving of scanning line. Thus, it becomes unnecessary to create a correction table for each line in advance and to store that in a large memory area, e.g., in a unit of frame, which leads to an advantage in terms of circuit size.

Further, in the present embodiment, it is configured such that a constant current signal having a duration corresponding to a gradation value is applied to each of the data lines DL as the data line driving signal. In this case, a value of reducing the duration is stored as a correction amount in the look-up table. To cope with an increase in luminance caused by the overshoot of the data line driving signal, the correction amount for reducing the duration of the constant current signal is stored, and the luminance is reduced using the correction amount. Thus, since it is possible to easily generate the count correction value by using the look-up table as a value corresponding to the duration of the constant current signal, the correction of an appropriate amount (the reduction of the duration) can be achieved.

In the present embodiment, one or both of the correction amount and the number of display data stored in the look-up table are rewritable by a command from the MPU 2. The relationship between the number of display data for each gradation value and the correction amount corresponding thereto may be changed according to the specification of the display unit 10. To that end, the look-up table is configured to be rewritable. Thus, the controller IC may be constituted by a chip that performs appropriate correction in conformity with various types of the display unit 10, and it is suitable for using general-purpose parts.

Further, as described with reference to FIG. 8D and steps S213 to S218 of FIG. 11, the correction value generating unit 44*a* does not perform the correction process for the display data of the gradation value for which data line driving signal has a duration equal to or less than a predetermined value. In other words, by setting the count correction value=0, the correction is not performed. When correcting the display data of the low gradation value, the low gradation area (e.g., black display area) becomes too much dark. For that reason, the correction is not performed for the display data of the gradation value corresponding to the data line driving signal which has the duration equal to or less than the predetermined value, thereby preventing the display at the low gradation value from becoming too dark.

Further, in the correction process, the correction amount for a gradation value is limited such that the corrected target count value for the gradation value becomes larger than a target count value for a gradation value immediately below the corresponding gradation value (steps S219 to S224 of FIG. 11). Thus, a difference in gradation between gradation values can be ensured even after the correction, and it is possible to maintain the differences between gradation values on the display image.

Although the embodiment has been described above, the display device and the display driver of the present invention may be modified in various ways without being limited to the above embodiment. For example, the correction table generation circuit 57 for performing the process of FIGS. 9, 10 and 11 may be achieved by the arithmetic processing unit (CPU, etc.), or a hardware configuration.

The look-up table storage unit 56 and the gradation table storage unit 54 may be provided in, e.g., a non-volatile memory (flash memory) or a volatile memory area such as D-RAM and S-RAM. Alternatively, in the case where the controller IC is a part dedicated to a specific display panel, the look-up table storage unit 56 and the gradation table storage unit 54 may use an area of ROM. Although the look-up table has been used to create the correction table, the correction amount may be obtained without using a look-up table by a predetermined function calculation using the number of display data for each gradation value.

Further, the process of FIGS. 9, 10 and 11 is exemplary. For example, the correction amounts for the respective gradation values may be directly obtained from the look-up table without performing the process of steps S207 to S212 of FIG. 10. Furthermore, the process of steps S213 to S218 of FIG. 11 in which the gradation value corresponding to the data line driving signal having a duration equal to or less than the predetermined threshold value is excluded from the correction may not be performed. It is also possible to conceive an example in which a gradation compensation process of steps S219 to S224 of FIG. 11 is not performed.

Further, the present invention is applicable not only to display devices using an OLED, but also to other types of display devices. For example, it is applicable to a display device using a self-luminous element of a current driving type.

While the invention has been shown and described with respect to the embodiments, it will be understood by those skilled in the art that various changes and modification may be made without departing from the scope of the invention as defined in the following claims.

What is claimed is:

1. A display driver for driving data lines in a display unit, the display unit including the data lines each of which is connected in common to a plurality of pixels arranged in a column direction, scanning lines each of which is connected in common to a plurality of pixels arranged in a row direction, and pixels formed to correspond to respective intersections of the data lines and the scanning lines, the display driver driving the data lines according to gradation values of the pixels, the display driver comprising:

a correction value generating unit configured to count the number of display data for each of the gradation values in display data corresponding to pixels on each of the scanning lines on a scanning line basis, and generate correction values of the display data based on the counting result; and a driving signal generating unit configured to perform a correction process to the display data by using the correction values generated by the correction value generating unit, and generate a data line driving signal for driving each of the data lines based on the corrected display data.

2. The display driver of claim 1, wherein the correction value generating unit obtains a correction amount according to the number of display data for each of the gradation values, and generates the correction values of the display data by using the obtained correction amount for each of the gradation values to calculate a correction amount for a gradation value higher than the gradation value corresponding to the obtained correction amount.

3. The display driver of claim 2, wherein the correction value generating unit generates the correction values according to the counting result of the number of display data for each of the gradation values by using a look-up table showing a correspondence between the number of display data for each of the gradation values and the correction amount therefor.

4. The display driver of claim 3, wherein a constant current signal having a duration corresponding to each of the gradation values is applied as the data line driving signal to the data lines, and wherein the correction amount stored in the look-up table corresponds to a value for shortening the duration.

5. The display driver of claim 4, wherein one or both of the correction amount and the number of display data stored in the look-up table is rewritable.

6. The display driver of claim 5, wherein a constant current signal having a duration corresponding to each of the gradation values is applied as the data line driving signal to the data lines, and wherein the correction value generating unit performs the correction process only for display data having a gradation value in which the corresponding duration is greater than a threshold value.

7. The display driver of claim 5, wherein the driving signal generating unit performs the correction process by limiting the correction amount such that a gradation value of the corrected display data becomes greater than a value corresponding to a gradation value immediately below the gradation value of the corrected display data.

8. The display driver of claim 3, wherein one or both of the correction amount and the number of display data stored in the look-up table is rewritable.

9. The display driver of claim 2, wherein a constant current signal having a duration corresponding to each of the gradation values is applied as the data line driving signal to the data lines, and wherein the correction value generating unit performs the correction process only for display data having a gradation value in which the corresponding duration is greater than a threshold value.

10. The display driver of claim 2, wherein the driving signal generating unit performs the correction process by limiting the correction amount such that a gradation value of the corrected display data becomes greater than a value corresponding to a gradation value immediately below the gradation value of the corrected display data.

11. The display driver of claim 1, wherein the correction value generating unit generates the correction values according to the counting result of the number of display data for each of the gradation values by using a look-up table showing a correspondence between the number of display data for each of the gradation values and a correction amount therefor.

12. The display driver of claim 11, wherein a constant current signal having a duration corresponding to each of the gradation values is applied as the data line driving signal to the data lines, and wherein the correction amount stored in the look-up table corresponds to a value for shortening the duration.

13. The display driver of claim 12, wherein one or both of the correction amount and the number of display data stored in the look-up table is rewritable.

14. The display driver of claim 11, wherein one or both of the correction amount and the number of display data stored in the look-up table is rewritable.

15. The display driver of claim 11, wherein a constant current signal having a duration corresponding to each of the gradation values is applied as the data line driving signal to the data lines, and wherein the correction value generating unit performs the correction process only for display data having a gradation value in which the corresponding duration is greater than a threshold value.

16. The display driver of claim 11, wherein the driving signal generating unit performs the correction process by limiting the correction amount such that a gradation value of the corrected display data becomes greater than a value corresponding to a gradation value immediately below the gradation value of the corrected display data.

17. The display driver of claim 1, wherein a constant current signal having a duration corresponding to each of the gradation values is applied as the data line driving signal to the data lines, and wherein the correction value generating unit performs the correction process only for display data having a gradation value in which the corresponding duration is greater than a threshold value.

18. The display driver of claim 1, wherein the driving signal generating unit performs the correction process by limiting a correction amount such that a gradation value of the corrected display data becomes greater than a value corresponding to a gradation value immediately below the gradation value of the corrected display data.

19. A display driving method for driving data lines according to gradation values of pixels in a display unit, the display unit including the data lines each of which is connected in common to a plurality of pixels arranged in a column direction, scanning lines each of which is connected in common to a plurality of pixels arranged in a row direction, and the pixels formed to correspond to respective intersections of the data lines and the scanning lines, the display driving method comprising:

counting the number of display data for each of the gradation values in display data corresponding to pixels on each of the scanning lines on a scanning line basis, and generating correction values of the display data according to the counting result; and performing a correction process to the display data by using the generated correction values, and generating a data line driving signal for driving each of the data lines based on the corrected display data.

20. A display device comprising:

a display unit including data lines each of which is connected in common to a plurality of pixels arranged in a column direction, scanning lines each of which is connected in common to a plurality of pixels arranged in a row direction, and pixels formed to correspond to respective intersections of the data lines and the scanning lines;

a display driver configured to drive each of the data lines according to gradation values of the corresponding pixels; and a scanning line driver configured to apply a scanning signal to the scanning lines, wherein the display driver includes:

a correction value generating unit configured to count the number of display data for each of the gradation values in display data corresponding to pixels on each of the scanning lines on a scanning line basis, and generate correction values of the display data based on the counting result; and a driving signal generating unit configured to perform a correction process to the display data by using the correction values generated by the correction value generating unit, and generate a data line driving signal for driving each of the data lines based on the corrected display data.

* * * * *